US008303078B2

(12) United States Patent
Inoue

(10) Patent No.: US 8,303,078 B2
(45) Date of Patent: Nov. 6, 2012

(54) LIQUID EJECTION APPARATUS AND LIQUID EJECTION SURFACE CLEANING METHOD

(75) Inventor: Hiroshi Inoue, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 870 days.

(21) Appl. No.: 11/889,404

(22) Filed: Aug. 13, 2007

(65) Prior Publication Data

US 2008/0049066 A1 Feb. 28, 2008

(30) Foreign Application Priority Data

Aug. 23, 2006 (JP) ..... 2006-226643

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS 5,396,277 A * 3/1995 Gast et al. ..... 347/33
5,557,306 A 9/1996 Fukushima et al.
5,617,122 A * 4/1997 Numata et al. ..... 347/14
6,158,839 A 12/2000 Fukushima et al.
6,276,784 B1 * 8/2001 Ikkatai et al. ..... 347/85
6,328,426 B1 * 12/2001 Chahn et al. ..... 347/55
2002/0085062 A1 7/2002 Ide et al.
2006/0007260 A1 * 1/2006 Oku ..... 347/19
2006/0197799 A1 * 9/2006 Sato et al. ..... 347/33

FOREIGN PATENT DOCUMENTS

JP 7-96604 A 4/1995
JP 2002-166560 A 6/2002

* cited by examiner

*Primary Examiner* — Matthew Luu
*Assistant Examiner* — Alejandro Valencia
(74) *Attorney, Agent, or Firm* — Birch, Stewart, Kolasch & Birch, LLP

(57) ABSTRACT

The liquid ejection apparatus has: a liquid ejection head having a liquid ejection surface in which a plurality of liquid ejection ports which eject liquid are arranged; a pressure adjustment device which adjusts pressure in the liquid ejection head; a head drive device which applies selectively, to the liquid ejection head, a liquid ejection drive waveform which causes the liquid to be ejected from the liquid ejection ports of the liquid ejection head, wherein: a first sliding motion is performed in a state where interior of the liquid ejection head is pressurized by the pressure adjusting device to set the surface of the liquid of each of the liquid ejection ports to a projecting shape, and where a meniscus slight vibration waveform is applied to the liquid ejection head by the head drive device, in such a manner that the liquid ejection surface is wetted by the liquid.

10 Claims, 13 Drawing Sheets

| MODE | CONTROL OBJECT | AMOUNT OF SEEPED INK | | |
|---|---|---|---|---|
| | | REDUCED | | INCREASED |
| 1 | SLIDING SPEED (RELATIVE SPEED BETWEEN CLEANING MEMBER AND HEAD) | FAST 120mm/sec | ←→ | SLOW 20mm/sec |
| 2 | BACK PRESSURE (PRESSURE OF HEAD) | LOW 0mmH2O | ←→ | HIGH 100mmH2O |
| 3 | NUMBER OF PRELIMINARY EJECTIONS | FEW 200 SHOTS | ←→ | MANY 20,000 SHOTS |
| 4 | ANGLE OF CONTACT (SURFACE PROPERTIES OF CLEANING MEMBER) | LOW 20 DEGREES | ←→ | HIGH 60 DEGREES |
| 5 | WAIT TIME | SHORT 0 SEC | ←→ | LONG 60 SEC |

FIG.7

| MODE | CONTROL OBJECT | AMOUNT OF SEEPED INK | | |
|---|---|---|---|---|
| | | REDUCED | | INCREASED |
| 1 | SLIDING SPEED (RELATIVE SPEED BETWEEN CLEANING MEMBER AND HEAD) | FAST 120mm/sec | ←→ | SLOW 20mm/sec |
| 2 | BACK PRESSURE (PRESSURE OF HEAD) | LOW 0mm$H_2O$ | ←→ | HIGH 100mm$H_2O$ |
| 3 | NUMBER OF PRELIMINARY EJECTIONS | FEW 200 SHOTS | ←→ | MANY 20,000 SHOTS |
| 4 | ANGLE OF CONTACT (SURFACE PROPERTIES OF CLEANING MEMBER) | LOW 20 DEGREES | ←→ | HIGH 60 DEGREES |
| 5 | WAIT TIME | SHORT 0 SEC | ←→ | LONG 60 SEC |

LIQUID EJECTION APPARATUS AND LIQUID EJECTION SURFACE CLEANING METHOD

BACKGROUND OF THE INVENTION

1. Field of the Invention

The present invention relates to a liquid ejection apparatus having a liquid ejection surface in which a plurality of liquid ejection ports for ejecting liquid are arranged, and to a liquid ejection surface cleaning method for cleaning a liquid ejection surface in which a plurality of liquid ejection ports are arranged.

2. Description of the Related Art

Conventionally, a liquid ejection apparatus is known which ejects liquid onto an ejection receiving medium, such as paper, by using a liquid ejection head (hereinafter, simply called "head") comprising liquid ejection ports which eject liquid, pressure chambers which connect to the liquid ejection ports, and pressure generating elements which generate a pressure inside the pressure chambers in order to eject liquid from the liquid ejection ports. An image is formed on an ejection receiving medium by means of an ink containing a coloring material being ejected onto the ejection receiving medium by means of a liquid ejection apparatus of this kind.

Japanese Patent Application Publication No. 2002-166560 describes an apparatus comprising: a cap (capping mechanism) which caps the liquid ejection ports of a head; a suctioning device which suctions ink, and the like, from the liquid ejection ports, by generating a negative pressure inside the cap by connecting the cap in a capping state and operating the pump; and a wiping device which wipes away foreign matter adhering to the liquid ejection surface of the head.

Japanese Patent Application Publication No. 7-96604 discloses an apparatus comprising: a head; a head drive device which selectively outputs a first signal for generating an ink droplet at a speed suitable for printing and a second signal for causing ink to seep out from liquid ejection ports; a cleaning apparatus which is normally positioned in the non-printing region and is movable in the lengthwise direction of the head during cleaning; a drive device which moves the cleaning apparatus relatively in the lengthwise direction of the head; a cleaning apparatus position determination device which determines the position of the cleaning apparatus; and a device which, on the basis of a cleaning command, determines the position of the cleaning apparatus by means of the cleaning apparatus position determination device and drives the pressure generating elements by means of the head drive device so as to cause ink to seep out from the liquid ejection ports in the vicinity of the position of the cleaning apparatus.

However, it is difficult to clean the liquid ejection surface satisfactorily while suppressing wasteful consumption of ink.

For example, in a mode where the head is covered with a cap and the ink is suctioned, in general, the majority of the ink is suctioned into the cap without adhering to the liquid ejection surface, and therefore it is difficult to remove satisfactorily any matter adhering to the liquid ejection surface. In order to make the ink adhere satisfactorily to the liquid ejection surface, it is necessary to fill the space between the cap and the liquid ejection surface of the head capped by the cap, with ink, but in a case of a matrix head having a plurality of liquid ejection ports, the cap is large in size and therefore a very large amount of ink is required, in addition to which the amount of ink adhering to the liquid ejection surface is restricted and hence the ink use efficiency is poor. In other words, it has been difficult to suppress wasteful consumption of ink, while at the same time cleaning the liquid ejection surface satisfactorily.

Furthermore, a mode can be envisaged in which ink is ejected towards a wiping device while foreign matter adhering to the liquid ejection surface is being wiped away with the wiping device, but this is problematic in that the ink is scattered about the periphery of the wiping device and soils the interior of the apparatus.

Moreover, in a mode which uses signals that cause ink to seep out from the liquid ejection ports, then although the vicinity of the liquid ejection ports is wetted with ink, areas which are distant from the liquid ejection ports are not wetted with ink and do not become wet, which means that material adhering to the liquid ejection surface cannot be removed satisfactorily. If the waveform is made larger in order to increase the amount of ink seeping out, then ink ejection will occur and consequently, it will not make the liquid ejection surface assume a wet state. In other words, it has been difficult to suppress wasteful consumption of ink, while at the same time cleaning the liquid ejection surface satisfactorily.

SUMMARY OF THE INVENTION

The present invention has been contrived in view of these circumstances, an object thereof being to provide a liquid ejection apparatus and a liquid ejection surface cleaning method whereby it is possible to improve the cleaning properties of a liquid ejection surface in which a plurality of liquid ejection ports are arranged, while suppressing wasteful consumption of liquid, by making the liquid ejection surface assume a state where it is sufficiently wetted by liquid which has been made to seep out from the liquid ejection ports.

In order to attain the aforementioned object, the present invention is directed to a liquid ejection apparatus, comprising: a liquid ejection head having a liquid ejection surface in which a plurality of liquid ejection ports which eject liquid are arranged; a pressure adjustment device which adjusts pressure in the liquid ejection head; a head drive device which applies selectively, to the liquid ejection head, a liquid ejection drive waveform which causes the liquid to be ejected from the liquid ejection ports of the liquid ejection head, and a meniscus slight vibration waveform which causes a surface of the liquid of each of the liquid ejection ports to perform slight vibration to an extent whereby the liquid is not ejected from the liquid ejection ports of the liquid ejection head; a cleaning member which slides over the liquid ejection surface of the liquid ejection head; and a control device which controls a first sliding motion in which the cleaning member slides over the liquid ejection surface of the liquid ejection head, and a second sliding motion in which the cleaning member slides over the liquid ejection surface of the liquid ejection head following the first sliding motion to wipe the liquid ejection surface, wherein: the first sliding motion is performed in a state where interior of the liquid ejection head is pressurized by the pressure adjusting device to set the surface of the liquid of each of the liquid ejection ports of the liquid ejection head to a projecting shape, and where the meniscus slight vibration waveform is applied to the liquid ejection head by the head drive device, in such a manner that the liquid ejection surface is wetted by the liquid which seeps out from the liquid ejection ports; and the second sliding motion is performed in a state where the application of the meniscus slight vibration waveform to the liquid ejection head is halted.

In this aspect of the present invention, since the first sliding motion is carried out in a state where the liquid surface of each of the liquid ejection ports of the liquid ejection head has a projecting shape and is in a state of slight vibration, then the liquid ejection surface is made to assume a sufficiently wetted state by means of the liquid that seeps out from the liquid ejection ports, and since the second sliding motion is carried out subsequently in a state where the slight vibration of the liquid surface is halted, then it is possible to wipe away the adhering matter and the liquid from the liquid ejection surface in a state where the liquid ejection surface is sufficiently wetted by the seeped ink. While the liquid ejection surface assumes a sufficiently wetted state due to the first sliding motion, the amount of liquid consumed is restricted to the minimum necessary amount, compared to a case where the liquid is suctioned from the liquid ejection ports, for example. Furthermore, since the second sliding motion is carried out in a state where the liquid ejection surface is sufficiently wetted, then damaging to the liquid ejection surface is prevented. Consequently, it is possible to improve the cleaning properties of the liquid ejection surface while suppressing wasteful consumption of liquid.

Preferably, in the first sliding motion, the control device sets the pressure in the liquid ejection head when the cleaning member slides over a particular region of the liquid ejection surface of the liquid ejection head, to a higher pressure than the pressure in the liquid ejection head when the cleaning member slides over other regions of the liquid ejection surface of the liquid ejection head, by using the pressure adjustment device.

Preferably, in the first sliding motion, the control device sets speed of the cleaning member with respect to the liquid ejection head when the cleaning member slides over a particular region of the liquid ejection surface of the liquid ejection head, to a slower speed than the speed of the cleaning member with respect to the liquid ejection head when the cleaning member slides over other regions of the liquid ejection surface of the liquid ejection head, by using the pressure adjustment device.

Preferably, the control device controls preliminary ejections in which the liquid is caused to be ejected preliminarily from the liquid ejection ports of the liquid ejection head by means of the head drive device prior to the first sliding motion in such a manner that number of the preliminary ejections from the liquid ejection ports in a particular region of the liquid ejection surface of the liquid ejection head is set to a greater number than the number of the preliminary ejections from the liquid ejection ports in other regions of the liquid ejection surface of the liquid ejection head.

Preferably, an angle of contact between the cleaning member and the liquid ejection surface in regions, other than a particular region, of the liquid ejection surface of the liquid ejection head is smaller than an angle of contact between the cleaning member and the liquid ejection surface in the particular region of the liquid ejection surface of the liquid ejection head.

Preferably, the particular region of the liquid ejection surface is a sliding start region where the cleaning member starts sliding over the liquid ejection surface of the liquid ejection head.

In order to attain the aforementioned object, the present invention is also directed to a liquid ejection surface cleaning method of cleaning a liquid ejection surface of a liquid ejection head having the liquid ejection surface in which a plurality of liquid ejection ports which eject liquid are arranged, by using a cleaning member which slides over the liquid ejection surface, the liquid ejection surface cleaning method comprising the steps of: sliding the cleaning member over the liquid ejection surface of the liquid ejection head, in a state where interior of the liquid ejection head is pressurized by using a pressure adjustment device which adjusts pressure in the liquid ejection head to set a surface of the liquid of each of the liquid ejection ports of the liquid ejection head to a projecting shape, and where a meniscus slight vibration waveform of an extent whereby the liquid is not ejected from the liquid ejection ports of the liquid ejection head is applied to the liquid ejection head by using a head drive device which drives the liquid ejection head to wet the liquid ejection surface with the liquid that seeps out from the liquid ejection ports; and sliding the cleaning member over the liquid ejection surface of the liquid ejection head in a state where the application of the meniscus slight vibration waveform to the liquid ejection head is halted to wipe the liquid ejection surface.

According to the present invention, the liquid ejection surface in which a plurality of liquid ejection ports are arranged is set to a state where it is sufficiently wetted by liquid which seeps out from the liquid ejection ports, and therefore it is possible to improve the cleaning properties of the liquid ejection surface while also suppressing wasteful consumption of liquid.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 7 is a diagram showing a list of various modes of adjusting the amount of seeped ink;

DETAILED DESCRIPTION OF THE PREFERRED EMBODIMENTS

Figure 1:
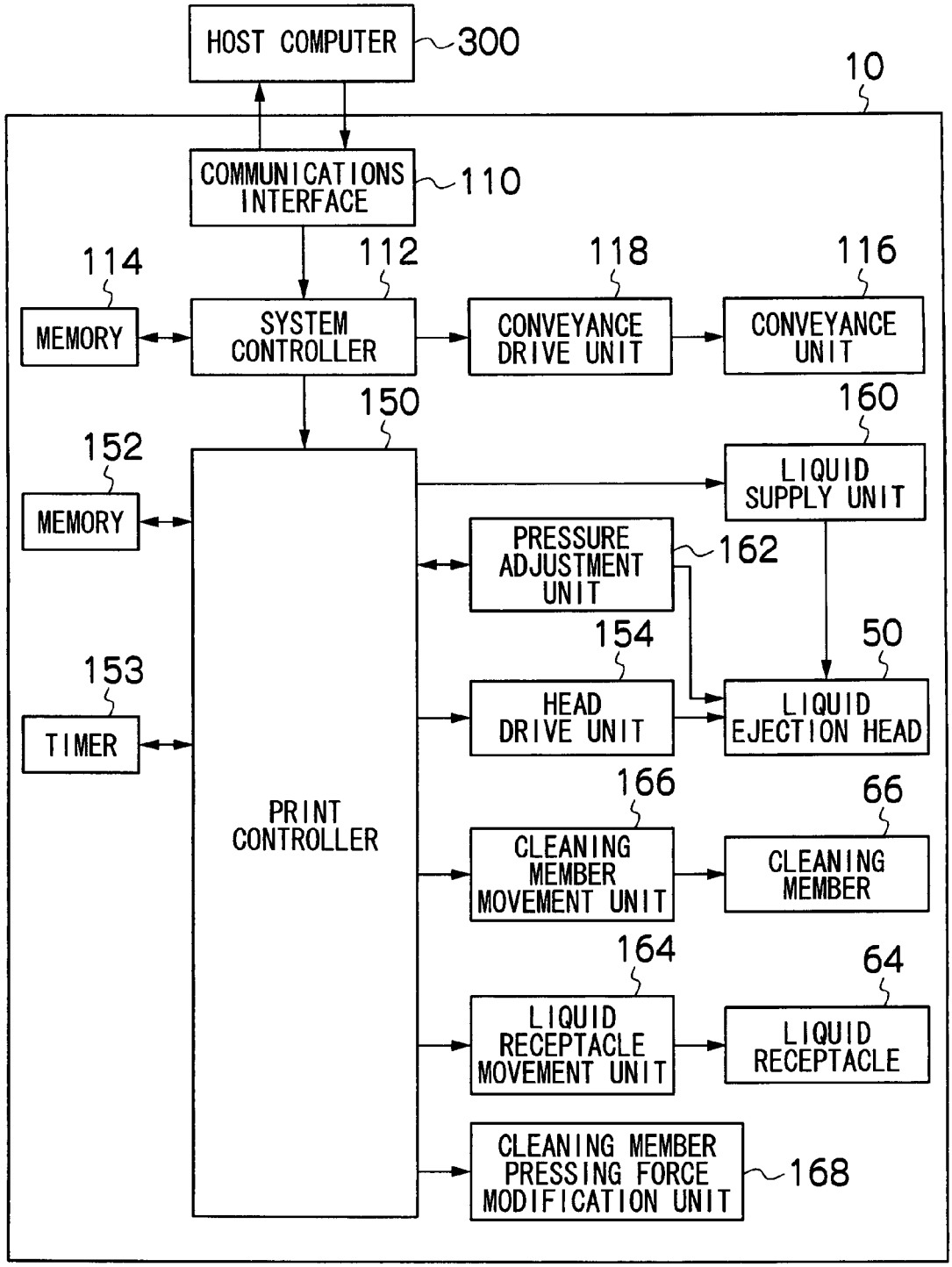
FIG. 1 is a block diagram showing an example of the general composition of an image forming apparatus according to one example of a liquid ejection apparatus according to the present invention.

FIG. 1 is a block diagram showing an example of the general composition of an image forming apparatus 10 according to one example of a liquid ejection apparatus according to the present invention.

In FIG. 1, the image forming apparatus 10 is principally constituted by: a head 50, a liquid receptacle 64, a cleaning member 66, a communications interface 110, a system controller 112, memories 114 and 152, a conveyance unit 116, a conveyance drive unit 118, a print controller 150, a timer 153, a head drive unit 154, a liquid supply unit 160, a pressure adjusting unit 162, a liquid receptacle movement unit 164, a cleaning member movement unit 166, and a cleaning member pressing force modification unit 168.

The head 50 (hereinafter simply called "head") has a liquid ejection surface in which a plurality of liquid ejection ports which eject liquid are arranged. The present embodiment is described below with respect to a case where ink is ejected as a liquid. For example, the image forming apparatus 10 comprises a total of four heads 50, one for each of the ink colors of black (K), cyan (C), magenta (M) and yellow (Y). A concrete example of the head 50 is described in detail below.

The liquid receptacle 64 receives liquid from the head 50 when the liquid ejection surface of the head 50 is cleaned. For example, a total of four liquid receptacles 64, one each for the respective heads 50 of the colors K, C, M, and Y, are provided. A concrete example of the liquid receptacle 64 is described in detail below.

The cleaning member 66 slides over the liquid ejection surface of the head 50 in which a plurality of liquid ejection ports are arranged, when the liquid ejection surface of the head 50 is cleaned. In actual practice, the image forming apparatus 10 according to the present embodiment has one or a plurality of cleaning members 66 for each of the heads 50 of the respective colors K, C, M and Y. A concrete example of the cleaning member 66 is described in detail below.

The communications interface 110 receives image data transmitted by a host computer 300. For the communications interface 110, a wired or wireless interface, such as a USB (Universal Serial Bus), IEEE 1394, or the like, can be used. The image data acquired by the image forming apparatus 10 via this communications interface 110 is stored temporarily in the first memory 114 for storing image data.

The system controller 112 is constituted by a microcomputer and peripheral circuits thereof, and the like, and it controls the whole of the image forming apparatus 10 in accordance with prescribed programs. More specifically, the system controller 112 controls the each of the units of the communications interface 110, the conveyance drive unit 118, the print controller 150, and the like.

The conveyance unit 116 comprises rollers (not illustrated) for conveying the ejection receiving medium, such as paper, and a motor (not illustrated) which applies a motive force to these rollers. The ejection receiving medium and the head 50 are moved relatively to each other, by means of this conveyance unit 116. The conveyance drive unit 118 includes a drive circuit which drives the conveyance unit 116 in accordance with instructions from the system controller 112.

The print controller 150 is constituted by a microcomputer and peripheral circuits of same, and the like, and it controls the liquid supply control unit, the timer 153, the head drive unit 154, the liquid supply unit 160, the pressure adjustment unit 162, the liquid receptacle movement unit 164, and the cleaning member movement unit 166, in accordance with prescribed programs.

The print controller 150 generates the data (dot data) necessary for forming dots on the ejection receiving medium by ejecting liquid droplets from the heads 50 onto the ejection receiving medium, on the basis of the image data input to the image forming apparatus 10. More specifically, in accordance with the control implemented by the system controller 112, the print controller 150 generates dot data for droplet ejection, from the image data inside the first memory 114, and it supplies the dot data thus generated to the head drive unit 154. The second memory 152 is appended to the print controller 150, and the dot data, and the like, is stored temporarily in the second memory 152 during image processing by the print controller 150.

The head drive unit 154 generates a drive signal (referred to below as "liquid ejection drive waveform") for ejecting ink from the liquid ejection ports of the head 50 (reference numeral 51 in FIGS. 2 and 3), on the basis of dot data supplied by the print controller 150 (in actual practice, the dot data stored in the second member 152) in accordance with instructions from the print controller 150, and it supplies this drive signal to the head 50 (and more specifically, to each of the piezoelectric elements 58 in FIG. 3, which are described hereinafter). Furthermore, in accordance with instructions from the print controller 150, the head drive unit 154 also generates a drive signal (referred to below as a "meniscus slight vibration waveform") which causes the free surface of the ink (the liquid-atmosphere interface, which is also commonly called the "meniscus") of the liquid ejection ports to perform a slight vibration to an extent where ink is not ejected from the liquid ejection ports of the head 50, and it supplies this drive signal to the head 50 (and more specifically, to each of the piezoelectric elements 58 in FIG. 3, which are described hereinafter). The head drive unit 154 supplies the liquid ejection drive waveform or the meniscus slight vibration waveform, selectively, to the head 50.

The liquid supply unit 160 serves to supply ink to the head 50 in accordance with instructions from the print controller 150. A concrete example of the liquid supply unit 160 is described in detail below.

The pressure adjustment unit 162 serves to adjust the pressure (back pressure) inside the head 51, in accordance with instructions from the print controller 150. A concrete example of the pressure adjustment unit 162 is described in detail below.

The liquid receptacle movement unit 164 causes the liquid receptacle 64 to move relatively with respect to the head 50, in accordance with instructions from the print controller 150, which is described below. More specifically, the liquid receptacle movement unit 164 is constituted by a commonly known mechanism and drive circuit including a motor for moving the liquid receptacle 64 (neither of these elements are shown in the drawings), and thereby moves the liquid receptacle 64 in a parallel direction or a perpendicular direction with respect to the liquid ejection surface of the head 50.

The cleaning member movement unit 166 causes the cleaning member 66 to move relatively with respect to the head 50, in accordance with instructions from the print controller 150, which is described below. More specifically, the cleaning member movement unit 166 is constituted by a commonly known mechanism and drive circuit including a motor for moving the cleaning member 66 (neither of these elements are shown in the drawings), and thereby moves the cleaning member 66 in a parallel direction or a perpendicular direction with respect to the liquid ejection surface of the head 50.

More specifically, the mechanism for moving the cleaning member movement unit 166 in the parallel direction uses a rack and pinion gear and a rail (neither of these elements being shown in the drawings) to move the cleaning member 66 in a direction parallel to the liquid ejection surface. It is also possible to adopt a mechanism in which the cleaning member 66 is fixed to a belt or a wire (neither of these elements are shown in the drawings), and the belt or wire is coupled to the rotational movement of a motor (not shown) and accordingly the rotational movement is converted into linear movement. Alternatively, it is also possible to adopt a mechanism which causes the cleaning member 66 to move linearly by means of a linear motor and a ball screw (neither of these elements being shown in the drawings).

More specifically, the perpendicular movement mechanism of the cleaning member movement unit 166 moves the cleaning member 66 in a perpendicular direction with respect to the liquid ejection surface, by means of a cam and link (neither of these elements are shown in the drawings). Furthermore, it is also possible to change the position of the cleaning member 66 by switching a solenoid (not shown) on and off. It is also possible to use pneumatic pressure or hydraulic pressure.

The cleaning unit pressing force modification unit 168 changes the pressure (pressing force) with which the cleaning member 66 is pressed against the liquid ejection surface of the head 50.

The print controller 150 implements: liquid supply control for supplying ink to the head 50 by means of the liquid supply unit 160; pressure adjustment control for adjusting the back pressure of the head 50 (the pressure inside the head 50) by means of the pressure adjustment unit 162; liquid receptacle movement control for moving the liquid receptacle 64 relatively with respect to the head 50 by means of the liquid receptacle movement unit 164; and cleaning member movement control for moving the cleaning member 66 relatively with respect to the head 50 by means of the cleaning member movement unit 166. The liquid supply control, the pressure adjustment control, the liquid receptacle movement control and the cleaning member movement control described above will be described in more detail later.

The timer 153 is used to measure the elapsed time since the start of sliding of the cleaning member 66, the wait time, and the like, in order to generate (determine) a timing at which to switch the amount of seeped ink. If the print controller 150 has a clock function, then the timer 153 may be omitted.

The print controller 150 executes a cleaning process for the liquid ejection surface of the head 50, and the like, in accordance with prescribed programs. During this cleaning process, the print controller 150 controls a first sliding motion for sliding the cleaning member 66 over the liquid ejection surface of the head 50, and controls, following this first sliding motion, a second sliding motion for sliding the cleaning member 66 over the liquid ejection surface of the head 50. The first sliding motion is carried out in a state where the interior of the head 50 is pressurized by means of the pressure adjustment unit 162, thereby causing the ink surface (meniscus) of the liquid ejection ports of the head 50 to assume a projecting shape, and a meniscus slight vibration waveform is applied to the head 50 by the head drive unit 154. The second sliding motion is carried out in a state where the application of the meniscus slight vibration waveform to the head 50 has halted. The details of this cleaning process are described below.

In FIG. 1, the system controller 112 and the print controller 150 are depicted separately, but these elements may be constituted by one microcomputer.

Figure 2:
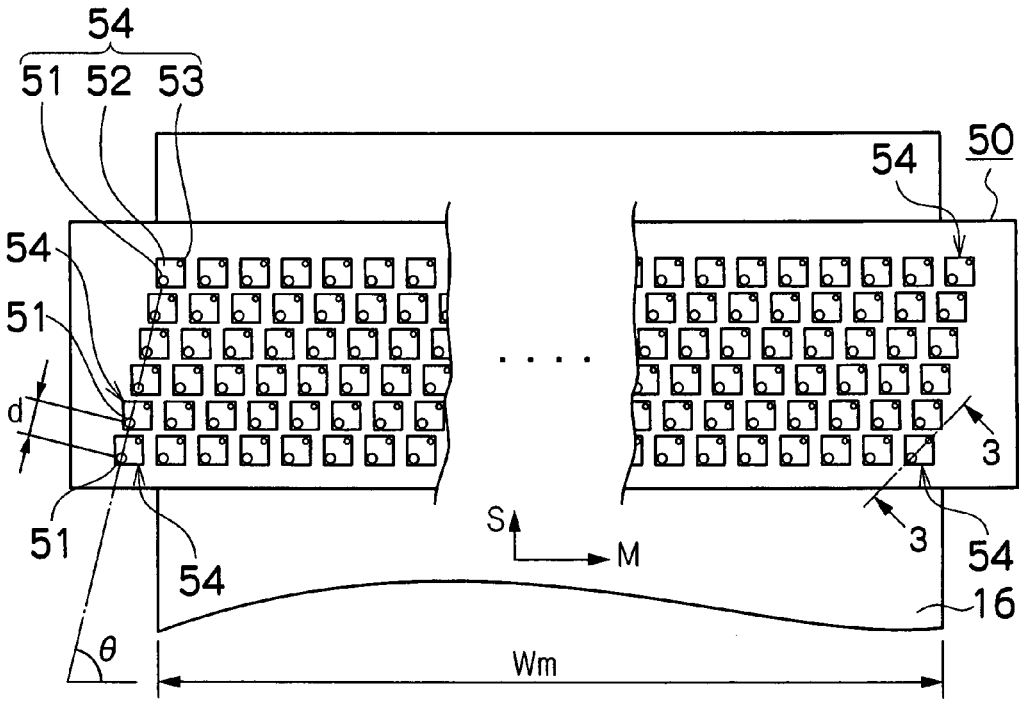
FIG. 2 is a plan view perspective diagram showing the general composition of one example of a head.
Figure 3:
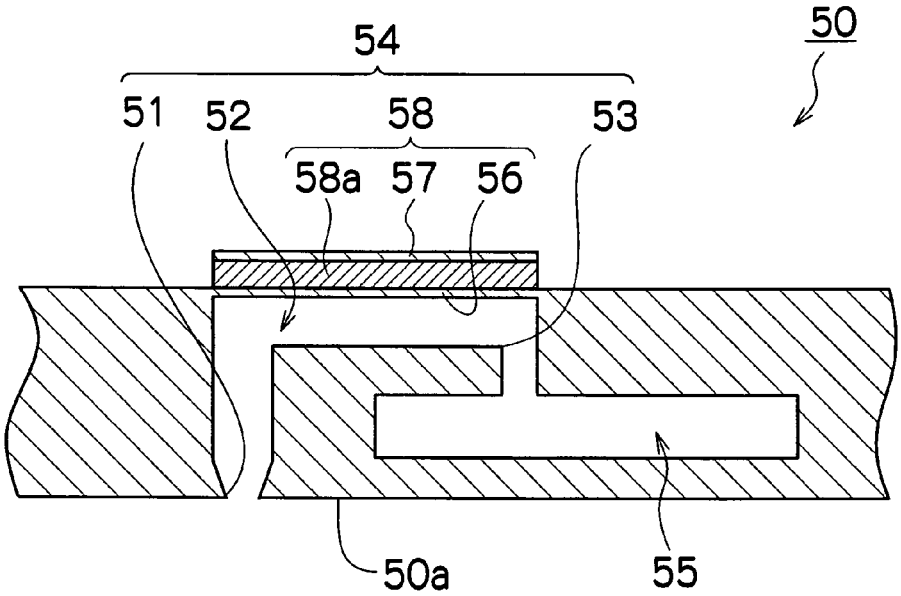
FIG. 3 is a cross-sectional diagram of the head along line 3-3 in FIG. 2.

FIG. 2 is a plan view perspective diagram showing the general composition of one example of the head 50 in FIG. 1; and FIG. 3 is a cross-sectional diagram along line 3-3 in FIG. 2.

The head 50 shown as an example in FIG. 2 is a so-called full line head, having a structure in which a plurality of liquid ejection ports 51 which eject droplets of ink toward a medium 16 are arranged in a two-dimensional configuration through a length corresponding to the width Wm of the ejection receiving medium 16 in the direction perpendicular to the direction of conveyance of the ejection receiving medium 16 (the sub-scanning direction indicated by arrow S in FIG. 2), in other words, in the main scanning direction indicated by arrow M in FIG. 2.

The head 50 comprises a plurality of ejection elements 54, each comprising a liquid ejection port 51, a pressure chamber 52 connected to the liquid ejection port 51, and a liquid supply port 53, the ejection elements 54 being arranged in two directions, namely, the main scanning direction M and an oblique direction forming a prescribed acute angle θ (where $0°<\theta<90°$) with respect to the main scanning direction M. In FIG. 2, in order to simplify the drawing, only a portion of the ejection elements 54 is depicted in the drawing.

In specific terms, the liquid ejection ports 51 are arranged at a uniform pitch d in the direction forming a prescribed acute angle of θ with respect to the main scanning direction M, and hence the nozzle arrangement can be treated as equivalent to a configuration in which nozzles are arranged at an interval of $d\times\cos\theta$ in a single straight line following the main scanning direction M.

FIG. 3 is a cross-sectional diagram along line 3-3 in FIG. 2, showing one of the ejection elements 54 which constitutes the head 50. In FIG. 3, only one ejection element 54 is depicted and therefore only one liquid ejection port 51 is arranged on the liquid ejection surface 50*a*, but in actual practice, a plurality of ejection elements 54 are arranged two-dimensionally in the head 50, as shown in FIG. 2, and a plurality of liquid ejection ports 51 are arranged two-dimensionally in the liquid ejection surface 50*a*.

As shown in FIG. 3, each pressure chamber 52 is connected to a common liquid chamber 55 via a liquid supply port 53. The common liquid chamber 55 is connected to the ink tank 60 shown in FIG. 4, which forms an ink supply source, via a sub tank 42 shown in FIG. 4, which is described hereinafter. In other words, the ink supplied from the ink tank 60 to the sub tank 42 is distributed and supplied to each of the pressure chambers 52 via the common liquid chamber 55.

A piezoelectric body 58*a* is disposed on top of a diaphragm 56, which constitutes the ceiling of each pressure chamber 52, and an individual electrode 57 is provided on top of this piezoelectric body 58*a*. The diaphragm 56 is earthed and also functions as a common electrode. Each piezoelectric element 58, which forms a device for generating pressure inside each pressure chamber 52, is constituted by the diaphragm 56, the individual electrode 57 and the piezoelectric body 58*a*.

When a liquid ejection drive waveform generated by the head drive unit 154 shown in FIG. 1 is applied to a piezoelectric element 58, in other words, when a drive voltage for ink ejection is applied to the individual electrode 57 of a piezoelectric element 58, then the piezoelectric body 58*a* deforms, the capacity of the pressure chamber 52 changes, and ink is ejected from the liquid ejection port 51 due to the resulting change in pressure inside the pressure chamber 52. When ink has been ejected, new ink is supplied to the pressure chamber 52 from the common flow chamber 55, via the liquid supply port 53.

Furthermore, if a meniscus slight vibration waveform generated by the head drive unit 154 in FIG. 1 is applied to a piezoelectric element 58, in other words, if a drive voltage for causing slight vibration of the liquid surface (meniscus) is applied to the individual electrode 57 of a piezoelectric element 58, then the piezoelectric body 58*a* deforms, the ink of the pressure chamber 52 performs a slight vibration, and consequently, the ink surface of the liquid ejection port 51 connected to the pressure chamber 52 also performs a slight vibration.

The ejection elements 54 shown in FIGS. 2 and 3 are simply one example, and are not limited in particular to cases such as these. For example, instead of disposing the common liquid chamber 55 below the pressure chamber 52 (in other words, disposing the common liquid chamber 55 closely to the liquid ejection surface 50*a*, in comparison with the pressure chamber 52), it is also possible to dispose the common liquid chamber 55 above the pressure chamber 52 (in other words, on the opposite side from the liquid ejection surface 50*a*).

Figure 4:
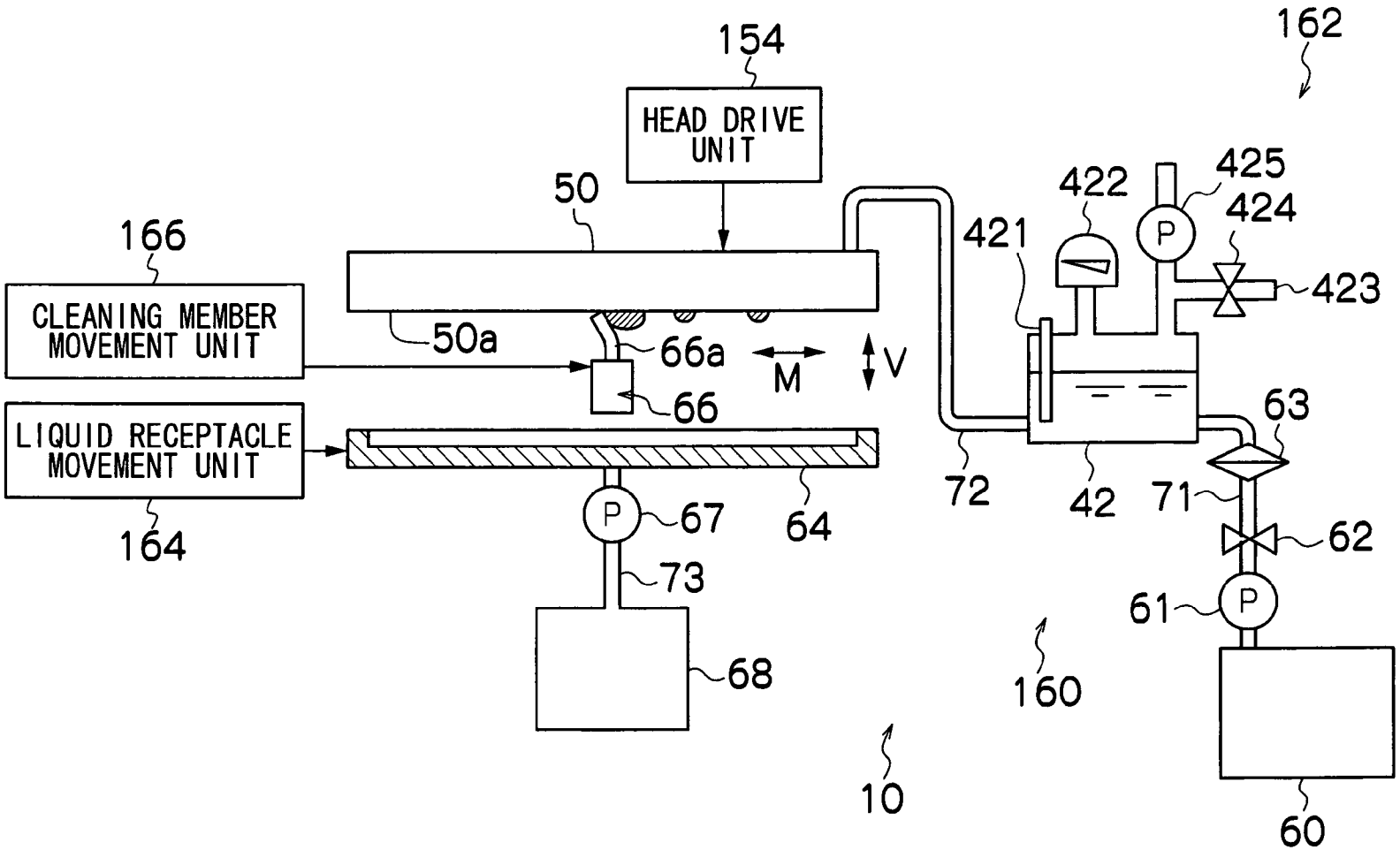
FIG. 4 is a general schematic drawing showing the principal part of an image forming apparatus.

FIG. 4 is a schematic drawing showing the principal part of the inkjet recording apparatus 10 including the head 50, the liquid receptacle 64, the cleaning member 66, the liquid supply unit 160 and the pressure adjustment unit 162 described with reference to FIG. 1.

Ink is supplied to the sub tank 42 from the ink tank 60 forming an ink supply source, via a first liquid supply channel 71. More specifically, by driving the liquid supply pump 61 in a state where the liquid supply valve 62 is opened, the ink in the ink tank 60 is sent to the sub tank 42, after dirt, air bubbles and the like have been removed by means of a filter 63. A remaining ink amount sensor 421 which determines the remaining amount of ink inside the sub tank 42 is provided with the sub tank 42. The ink inside the sub tank 42 is supplied to the head 50 via a second liquid supply channel 72.

Furthermore, a pressure meter 422, an atmosphere connection port 423, an atmosphere opening valve 424 and a pressure adjustment pump 425 are attached to the sub tank 42.

The pressure meter 422 measures the pressure inside the sub tank 42, and thereby measures the back pressure of the head 50, namely, the pressure inside the head 50. The atmosphere opening valve 424 is a valve which opens and closes the connection between the atmosphere connection port 423 and the sub tank 42. The pressure adjustment pump 425 adjusts the pressure inside the sub tank 42, and hence the back pressure of the head 50, by replenishing or expelling gas (air), to or from the sub tank 42, in a state where the atmosphere opening valve 424 is open.

The liquid supply unit 160 shown in FIG. 1 is constituted by the ink tank 60, the liquid supply pump 61, the liquid supply valve 62, the filter 63, the first liquid supply channel 71, the second liquid supply channel 72, the sub tank 42, the remaining ink amount sensor 421, the pressure meter 422, the atmosphere connection port 423, the atmosphere opening valve 424 and the pressure adjustment pump 425 described above.

Moreover, the pressure adjustment unit 162 shown in FIG. 1 is constituted by the pressure meter 422, the atmosphere connection port 423, the atmosphere opening valve 424 and the pressure adjustment pump 425. By adjusting the pressure inside the sub tank 42 by means of the pressure adjustment unit 162 of this kind, the back pressure of the head 50 is adjusted.

By means of the cleaning member movement unit 166, the cleaning member 66 is movable in the direction perpendicular to the liquid ejection surface 50*a* of the head 50 (the perpendicular direction indicated by the arrow V shown in FIG. 4), and furthermore, is also movable in the direction parallel to the liquid ejection surface 50*a* of the head 50 (the main scanning direction of the head 50 indicated by the arrow M in FIG. 4; also called the "sliding direction").

The cleaning member 66 has a blade 66*a* which slides over the liquid ejection surface 50*a* of the head 50 while abutting against the liquid ejection surface 50*a* of the head 50.

The material of the blade 66*a* of the cleaning member 66 is, for example, silicon rubber, EPDM (ethylene-propylene-diene rubber), NBR (nitrile rubber), or urethane rubber. In the present example, HNBR (hydrogenated nitrile rubber) formed by adding hydrogen to NBR is used.

Generally, the cleaning member 66 is withdrawn from below the liquid ejection surface 50*a* of the head 50, by the cleaning member movement unit 166, and is moved to a prescribed withdrawal position (a position where it does not interfere with ink ejection from the head 50), but when the liquid ejection surface 50*a* of the head 50 is to be cleaned, then the blade 66*a* is abutted against the liquid ejection surface 50*a* of the head 50 and slid over the liquid ejection surface 50*a*.

The liquid receptacle 64 receives ink purged (by dummy ejection) from the head 50 and ink wiped away from the head 50 by the cleaning member 66. Furthermore, the liquid receptacle 64 also functions as a cap for sealing the liquid ejection surface 50*a* of the head 50.

The liquid receptacle 64 is generally in a state where it has been withdrawn from below the liquid ejection surface 50*a* of the head 50 and has been moved to a prescribed withdrawal position (a position where it does not interfere with the ink ejection from the head 50) by means of the liquid receptacle movement unit 164, and when cleaning of the liquid ejection surface 50*a* of the head 50 is to be carried out, then the liquid receptacle 64 is moved to a prescribed maintenance position below the liquid ejection surface 50*a* of the head 50 (in other words, a position where it can receive ink from the head 50).

When the recovery pump 67 is driven, then the ink received in the liquid receptacle 64 from the head 50 is sent to the recovery tank 68 via the liquid recovery flow channel 73.

Next, the wetting of the liquid ejection surface 50*a* is described with reference to FIGS. 5A, 5B and 5C which show schematic views of the state of the ink surface (meniscus) of a liquid ejection port 51 of the head 50.

Figure 5A:
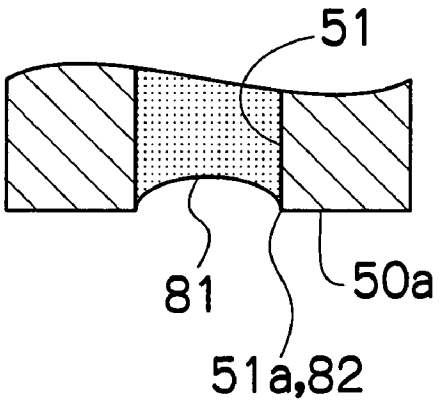
FIG. 5A is a schematic drawing showing an aspect of the ink surface (meniscus) during ejection standby.

When at standby for ejection, the back pressure of the head 50 is kept to a negative pressure (a pressure which is lower than the atmospheric pressure) by means of the pressure adjustment unit 162, and therefore the ink surface 81 of the liquid ejection port 51 is kept to a recessed shape, as shown in FIG. 5A. Here, the circumferential edge 82 (clip point) of the ink surface 81 coincides substantially with the circumferential edge 51*a* of the liquid ejection port 51.

In a state of this kind as shown in FIG. 5A, the back pressure of the head 50 is switched from negative pressure to positive pressure (a pressure higher than atmospheric pressure) by the pressure adjusting unit 162, and furthermore, the meniscus slight vibration waveform is applied from the head drive unit 154 to the piezoelectric elements 58 of the head 50 shown in FIG. 3. By so doing, as shown in FIG. 5B, the ink surface 81 in the liquid ejection port 51 assumes a projecting shape and performs a slight vibration. In this case, the circumferential edge 82 (clip point) of the ink surface 81 broadens slightly from the circumferential edge 51*a* of the liquid ejection port 51 to the outer side of the circumferential edge 51*a*, compared to the state during ejection standby shown in FIG. 5A. In other words, ink seeps out slightly from the liquid ejection port 51. Due to this initial seepage of the ink, adhering material which is adhering to the circumferential edge 51*a* of the liquid ejection port 51 or is in the very close proximity of this circumferential edge 51*a* is either dissolved in the ink which has seeped out, or peels off and floats in the ink which has seeped out.

Figure 5B:
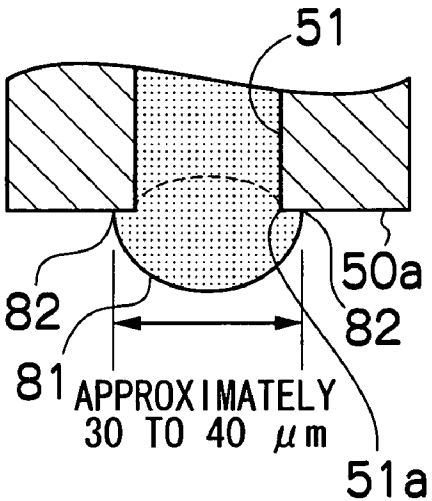
FIG. 5B is a schematic drawing showing an aspect of the ink surface immediately after pressurization and the start of slight vibration of the liquid surface.
Figure 5C:
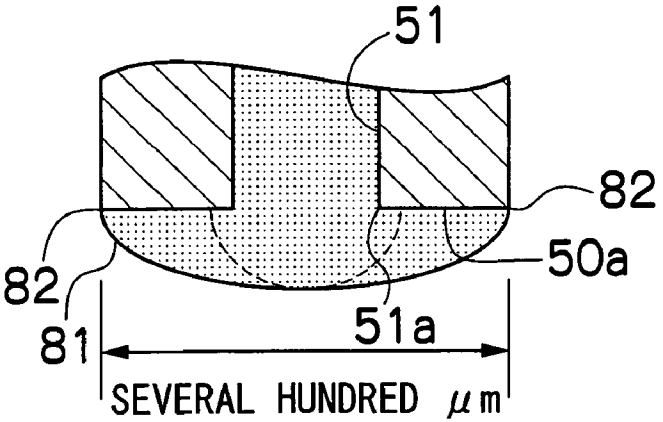
FIG. 5C is a schematic drawing showing an aspect of the ink surface immediately after wetting.

However, in the state shown in FIG. 5B, the increase in the diameter of the ink surface 81 due to seepage of ink is small compared to the diameter of the liquid ejection port 51. For example, if the diameter of the liquid ejection port 51 was approximately 30 μm, then on the basis of microscopic examination, the diameter of the ink surface 81 was limited to spreading through approximately several μm. Therefore, it is difficult to remove fibers, dust particles, or the like, which are longer than the diameter of the ink surface 81. Furthermore, satellite liquid droplets and mist, and the like, which are generated with the main liquid droplets during ink ejection are liable to adhere to positions which are distant from the liquid ejection ports 51, due to the force of electrostatic repulsion between the liquid droplets, and they become fixed onto the liquid ejection surface 50*a*. The adhering material formed by ink droplets which have become fixed to the liquid ejection surface 50*a* in this way creates soiling on the liquid ejection surface 50*a* (which is formed with a lyophobic film, for example). Adhering material of the kind described above may drop off the liquid ejection surface 50*a* during ejection, or even if it does not drop off, it may come into contact with the ejection receiving medium, such as paper, and therefore such adhering material causes degradation of the image.

Therefore, the cleaning member 66 is slid over the liquid ejection surface 50*a* in the state shown in FIG. 5B, in other words, in a state where the back pressure of the head 50 is kept at a positive pressure and the meniscus slight vibration waveform is applied to the piezoelectric elements 58 of the head 50. By this means, the cleaning member 66 is made to contact the ink surface 81 which has a projecting shape and is in state of a slight vibration, the ink spreads over the liquid ejection surface 50*a*, and the periphery of the liquid ejection port 51 assumes a wet state as it becomes wetted by the ink, as shown in FIG. 5C. If, for example, the diameter of the ink surface 81 was approximately 30 to 40 μm in the state shown in FIG. 5B, then the diameter of the ink surface 81 spread to several hundred μm.

This action of sliding the cleaning member 66 over the liquid ejection surface 50*a* in this way, in other words, moving the cleaning member 66 with respect to the liquid ejection surface 50*a* of the head 50 while the ink surface 81 has a projecting shape and is in a state of slight vibration, and thereby wetting the periphery of the liquid ejection ports 51 with ink, is called the "wetting sliding process" or the "first sliding process" below.

After the wetting sliding process, a state where the meniscus slight vibration waveform is applied to the piezoelectric elements 58 of the head 50 is maintained for a prescribed time (hereinafter, called the "wait time"). By causing the ink surface 81 to perform slight vibration, the wetting surface area of the ink gradually broadens, and ultimately, the ink from the mutually adjacent liquid ejection ports 51 connects together. Thereby, the solidified ink at the periphery of the liquid ejection ports 51 dissolves into the ink.

Ink which seeps out from liquid ejection ports 51 and wets the liquid ejection surface 50*a* of the head 50 in this way is called "seeped ink" below, and the amount of this ink is called "amount of seeped ink" below.

The application of the meniscus slight vibration waveform is halted after the wait time has elapsed, and the cleaning member 66 is then slid over the liquid ejection surface 50*a* in order to remove the adhering material and the seeped ink which are present on the liquid ejection surface 50*a* of the head 50. Here, the back pressure of the head 50 may be kept at a positive pressure during the sliding action of the cleaning member 66 in order that the ink which has seeped out to the periphery of the liquid ejection port 51 does not return into the liquid ejection ports 51; however, if the cleaning member 66 is slid within a short period of time, even without keeping the back pressure of the head 50 at a positive pressure, then the periphery of the liquid ejection port 51 will still be in a wet state, and therefore the back pressure of the head 50 does not have to be kept at a positive pressure in the case of a composition which slides the cleaning member 66 within a short period of time.

The action of sliding the cleaning member 66 over the liquid ejection surface 50*a* in this way, in other words, moving the cleaning member 66 relatively with respect to the liquid ejection surface 50*a* of the head 50 in a state where the seeped ink has wetted the periphery of the liquid ejection ports 51 (wet state) and the slight vibration has halted, thereby removing the ink in the periphery of the liquid ejection ports 51, is called a "wiping sliding process" or a "second sliding process".

The wetting sliding process mentioned above is described in more detail with reference to the schematic drawings shown in FIGS. 6A to 6H.

Figure 6A:
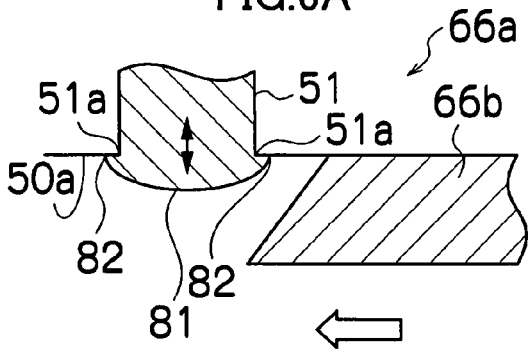
FIGS. 6A to 6H are schematic drawings illustrating a wetting sliding motion.
Figure 6E:
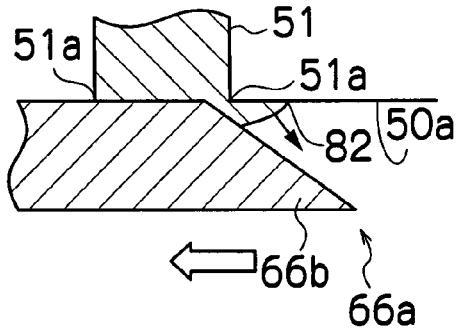
Figure 6B:
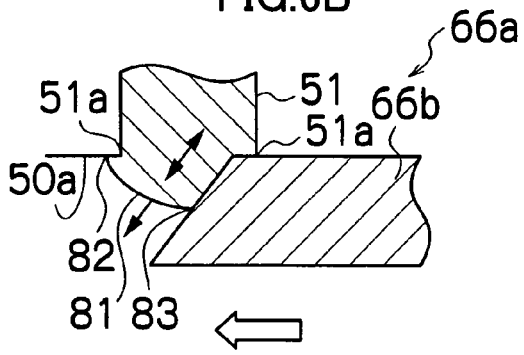
Figure 6F:
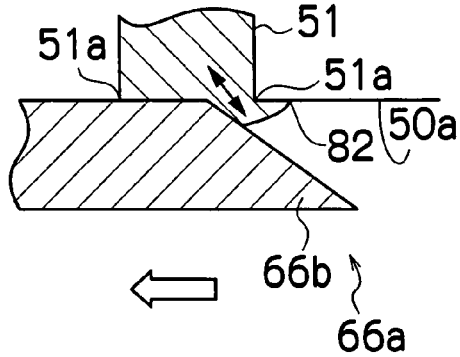
Figure 6C:
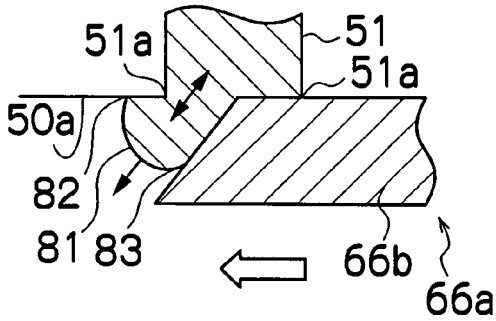
Figure 6G:
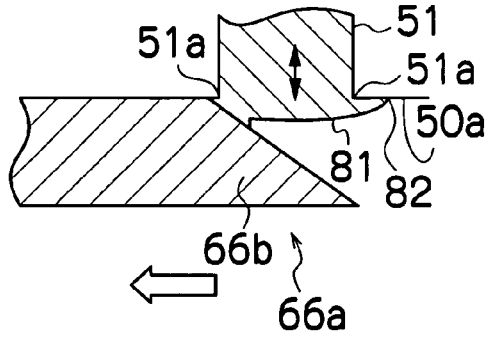
Figure 6D:
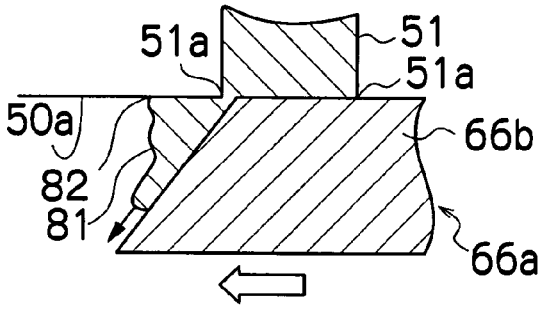
Figure 6H:
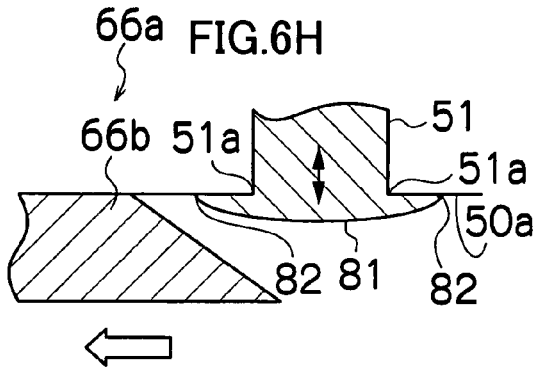

As shown in FIG. 6A, by setting the back pressure of the head 50 to a positive pressure and setting the ink surface 81 to a projecting shape, as well as causing the ink surface 81 in a projecting shape to perform a slight vibration by applying the meniscus slight vibration waveform to the piezoelectric element 58, the ink surface 81 formed by the ink which has seeped out from the liquid ejection port 51 broadens slightly beyond the diameter of the liquid ejection port 51. On the other hand, when the front end portion 66*b* of the blade 66*a* of the cleaning member 66 approaches the liquid ejection port 51 and arrives at a position over a liquid ejection port 51, as shown in FIG. 6B, then the ink surface 81 mounds up slightly between the circumferential edge 51*a* of the liquid ejection port 51 and the front end portion 66*b* of the blade 66*a*. More specifically, mounding of the ink surface 81 occurs between the clip points indicated by the reference numerals 82 and 83 in FIG. 6B, and as shown in FIG. 6C, the clip point 82 at the circumferential edge of the ink surface 81 further broadens with respect to the circumferential edge 51*a* of the liquid ejection port 51. As shown in FIG. 6D, the ink surface 81 then ruptures and a very small amount of ink flows down the oblique surface of the blade 66*a*. On the other hand, as shown in FIGS. 6E, 6F and 6G, the ink adhering to the front end portion 66*b* of the blade 66*a* is spread successively to the periphery of the liquid ejection port 51. As shown in FIG. 6H, the ink which has spread to the periphery of the liquid ejection port 51 does not flow back into the liquid ejection port 51, due to the positive pressure of the head 50.

The wetting sliding process and the wiping sliding process described above, and the like, are implemented by the print controller 150 in FIG. 1 using the timer 153, the head drive unit 154, the pressure adjustment unit 162, the cleaning member movement unit 166 and the like.

FIG. 7 shows a list of various modes of adjusting the amount of seeped ink.

Firstly, there is a mode which adjusts the amount of seeped ink by adjusting the sliding speed, in other words, by adjusting the relative speed of the cleaning member 66 and the head 50.

For example, if the sliding speed changes in the range of 20 to 120 (mm/sec), then the faster the sliding speed (the nearer the speed to the upper limit of 120 (mm/sec)), the smaller the amount of seeped ink, and the slower the sliding speed (the nearer the speed to the lower limit of 20 (mm/sec)), the greater the amount of seeped ink.

Figure 8:
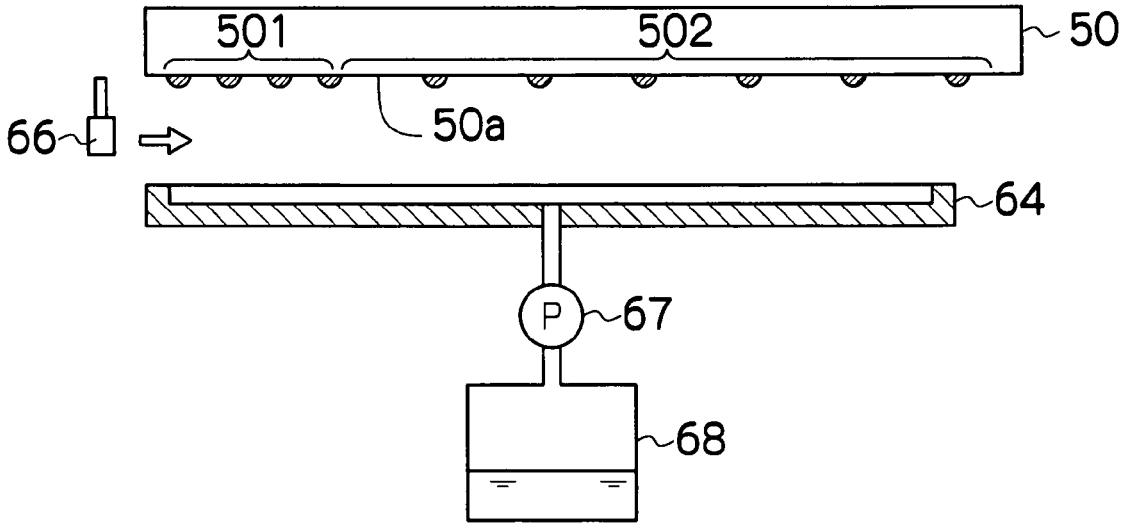
FIG. 8 is an illustrative diagram illustrating one example of the adjustment of the amount of seeped ink.

In FIG. 8, the sliding speed when the cleaning member 66 is slid over a prescribed sliding start region 501 of the liquid ejection surface 50*a* of the head 50 is set to be slower than the sliding speed when the cleaning member 66 is slid over the region 502 of the liquid ejection surface 50*a* of the head 50 apart from the sliding start region, including the sliding end region.

By this means, it is possible to increase the amount of seeped ink at the start of sliding, and to push and spread the ink which has seeped out at the start of sliding, over the liquid ejection surface 50*a*, by means of the cleaning member 66. Therefore, only a small amount of ink is required, the closer the position to the sliding end point. Furthermore, from the viewpoint of preventing damage to the liquid ejection surface 50*a* of the head 50, a sufficient amount of ink should be made to seep out at the start of sliding. Therefore, for example, the sliding speed in the sliding start region 501 is 20 (mm/sec) and the sliding speed in the region 502 other than this is switched to 80 (mm/sec). If the speed is set to 120 (mm/sec), then further reduction in the amount of ink can be expected, but since this gives rise to increased size and costs of the cleaning member movement unit 166, a speed of 80 (mm/sec) is selected.

The switching of the sliding speed is carried out by the print controller 150 in FIG. 1, for example, using the cleaning member movement unit 166 and the timer 153. The elapsed time from the sliding start time is counted by the timer 153 in FIG. 1, and if it has exceeded a previously determined time, then the sliding speed is switched.

Figure 9:
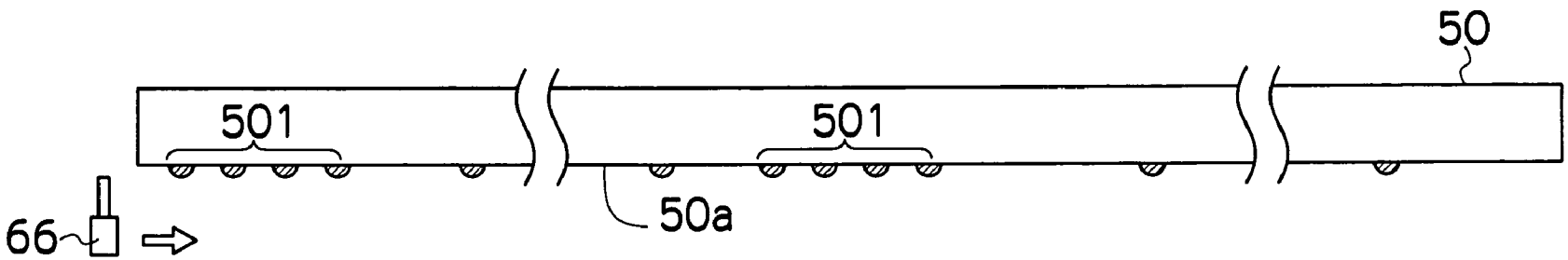
FIG. 9 is an illustrative diagram illustrating a further example of the adjustment of the amount of seeped ink.

Furthermore, as shown in FIG. 9, if the head is a long head, in other words, if the sliding distance of the cleaning member 66 is long, then it is effective to provide regions 501 in which the amount of seeped ink is increased, in other words, to provide regions 501 where the sliding speed is slowed, at uniform intervals.

Moreover, the sliding speed may be changed continuously or it may be changed in a stepwise fashion. By changing the sliding speed in a continuous fashion or a stepwise fashion in this way, then even in the case of a long head, it is possible to change the amount of ink seeping from the liquid ejection ports 51, precisely in detail, in accordance with the sliding position.

It is also possible to provide a device (not shown) which determines the sliding position of the cleaning member 66, without using the timer 153, in such a manner that the sliding speed is changed when the sliding position has reached a previously determined position.

By combining with determination of abnormal ejection (including manual determination by means of a nozzle check pattern), the sliding speed in a portion where there is an abnormal nozzle is slowed, in such a manner that that portion is wetted and cleaned satisfactorily. It is also possible to achieve effective cleaning by means of a small amount of ink.

The reason that the amount of seeped ink reduces when the sliding speed is accelerated is that, in the states shown in FIGS. 6B and 6C, the cleaning member 66 passes over the periphery of the liquid ejection port 51 before ink has spread abundantly onto the periphery of the liquid ejection port 51.

Secondly, there is a mode which adjusts the amount of seeped ink by adjusting the back pressure, in other words, by adjusting the internal pressure of the head 50.

For example, if the back pressure is changed within a range of 0 to 100 ($mmH_2O$), then the lower the back pressure (the nearer the back pressure to the lower limit of 0 ($mmH_2O$)), the smaller the amount of seeped ink, and the higher the back pressure (the nearer the back pressure to the upper limit of 100 ($mmH_2O$)), the greater the amount of seeped ink.

Satisfactory effects were obtained within the range of 0 to 100 ($mmH_2O$), but since the satisfactory value of the back pressure varies according to the nozzle diameter, the type of ink, the material of the cleaning member 66, the lyophobic properties of the liquid ejection surface 50*a*, then the back pressure must be set accordingly.

Moreover, if the back pressure is excessively high, then the ink will overflow after the second sliding motion. Conversely, if the back pressure is excessively low, then sufficient ink does not seep out during the first sliding motion, and this hinders the dissolving of the solidified ink.

In FIG. 8, the back pressure when the cleaning member 66 is slid over a prescribed sliding start region 501 of the liquid ejection surface 50*a* of the head 50 is set to be higher than the back pressure when the cleaning member 66 is slid over the region 502 of the liquid ejection surface 50*a* of the head 50 apart from the sliding start region, including the sliding end region. In this way also, similar beneficial effects to those of the first mode are obtained.

The switching of the back pressure of the head 50 is carried out by the print controller 150 in FIG. 1, for example, using the pressure adjustment unit 162 and the timer 153. The elapsed time from the sliding start time is counted by the timer 153 in FIG. 1, and if it has exceeded a previously determined time, then the back pressure in the head 50 is switched.

Furthermore, as shown in FIG. 9, if the sliding distance is long, then it is effective to provide regions 501 in which the amount of seeped ink is increased, in other words, to provide the regions 501 where the sliding speed is slowed, at uniform intervals. Moreover, the back pressure of the head 50 may be changed continuously or it may be changed in a stepwise fashion. It is also possible to provide a device (not shown) which determines the sliding position of the cleaning member 66, without using the timer 153, in such a manner that the back pressure of the head 50 is changed when the sliding position has reached a previously determined position.

Furthermore, in the case of a long head, by dividing the common liquid chamber 55 of the head 50 and providing a sub tank 42 for each of the resulting common liquid chambers 55, it is possible to adjust the amount of seeped ink at periodic intervals, by changing the back pressures respectively and independently for the sub tanks 42.

Moreover, the method of adjusting the back pressure (rear pressure) of the head 50 is described above with respect to an example in which the internal pressure of the sub tank 42 is adjusted, but it is also possible to pressurize the ink in the ink tank 60 directly. Furthermore, by connecting the sub tank 42 to the atmosphere and providing a mechanism which raises or lowers the sub tank 42, it is also possible to vary the back pressure of the head 50 by means of the water head differential between the liquid surface in the sub tank 42 and the liquid ejection surface 50*a* of the head 50.

Thirdly, there is a mode which controls the amount of seeped ink by adjusting the number of preliminary ejections, in other words, by adjusting the number of ejections from each of the liquid ejection ports 51 in the purging (dummy ejection) before wetting.

For example, if the number of preliminary ejections from each of the liquid ejection ports 51 is changed within a range of 200 to 20000 (shots), then the smaller the number of preliminary ejections (the nearer the number of preliminary ejections to the lower limit of 200 (shots)), the smaller the amount of seeped ink, and the higher the number of preliminary ejections (the nearer the number of preliminary ejections to the upper limit of 20000 (shots)), the greater the amount of seeped ink.

In FIG. 8, the number of preliminary ejections from each of the liquid ejection ports 51 in the region 502 apart from the sliding start region on the liquid ejection surface 50*a* of the head 50, including the sliding end region, is made lower than the number of preliminary ejections from each of the liquid ejection ports 51 performed in the prescribed sliding start region 501 of the liquid ejection surface 50*a* of the head 50. For example, in the sliding start region 501, 20000 (shots) are performed at each liquid ejection port 51, and in the region 502 apart from this, 200 (shots) are performed at each liquid ejection port 51.

The number of preliminary ejections at each liquid ejection port 51 is adjusted by the print controller 150 in FIG. 1, by means of the head drive unit 154.

The reason that the amount of seeped ink decreases if the number of preliminary ejections is reduced is thought to be due to the increase in the viscosity of the ink of the liquid ejection ports 51.

Fourthly, there is a mode in which the amount of seeped ink is adjusted by switching the angle of contact, in other words, by adjusting the angle formed between the surface of the cleaning member 66 and the surface of the ink in a state where the small ink droplet is mounted on the surface of the cleaning member 66 (this angle of contact indicates the surface properties of the cleaning member 66 with respect to the ink).

For example, if the angle of contact is changed within a range of 20 to 60 (degrees), then the lower the angle of contact (the nearer the angle of contact to the lower limit of 20 (degrees)), the smaller the amount of seeped ink, and the higher the angle of contact (the nearer the angle of contact to the upper limit of 60 (degrees)), the greater the amount of seeped ink.

Figure 10A:
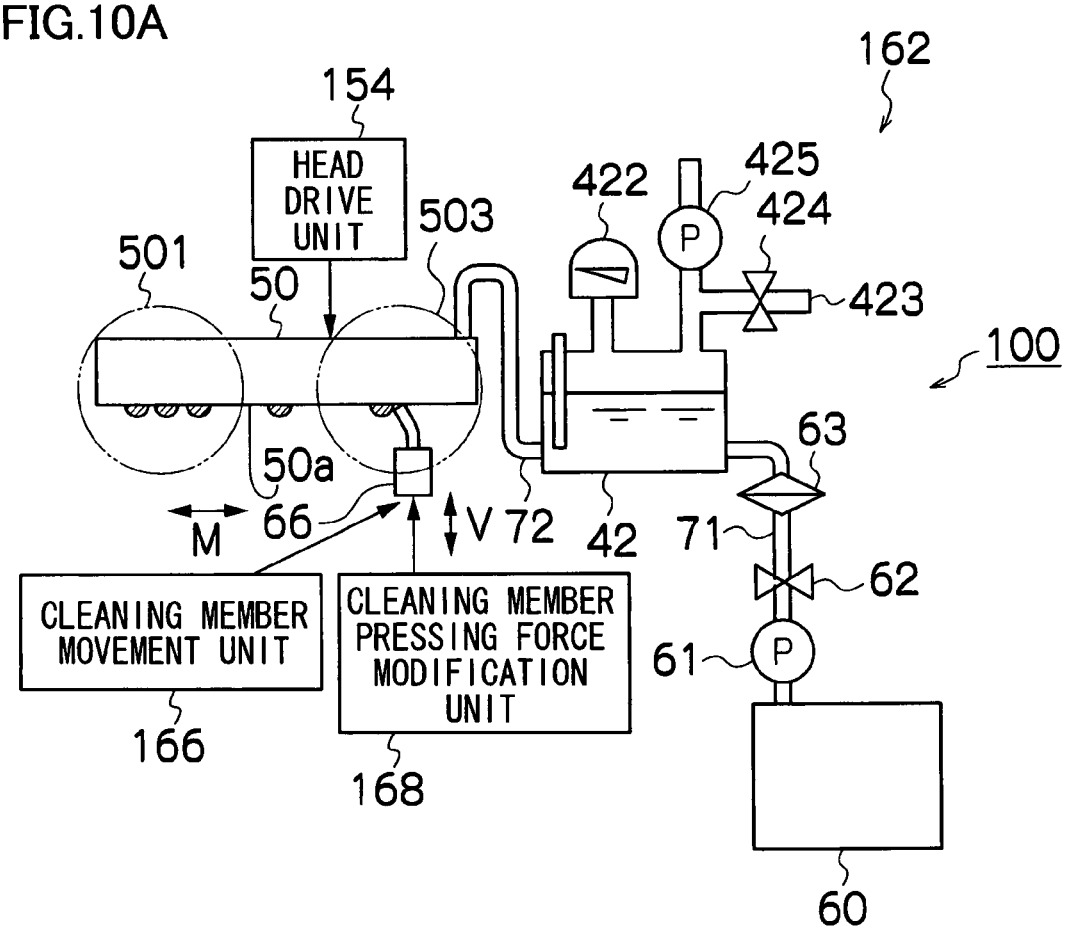
FIGS. 10A to 10E are schematic drawings which show one example of a mode for adjusting the amount of seeped ink by means of the angle of contact between the cleaning member and the ink.
Figure 10B:
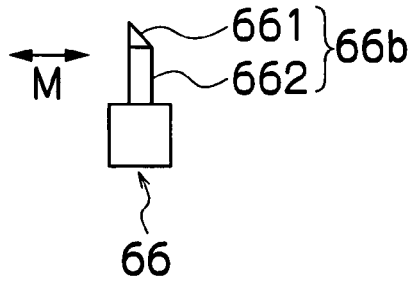
Figure 10C:
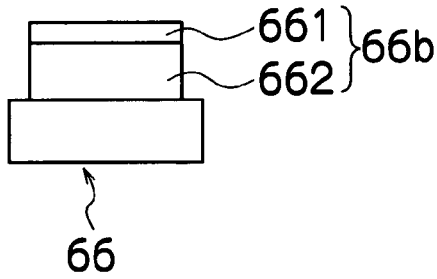

FIG. 10A is a principal schematic drawing showing an image forming apparatus 100 which is suited to the fourth mode. The image forming apparatus 100 in FIG. 10A comprises the cleaning member 66 shown in FIGS. 10B and 10C. FIG. 10B is a side view diagram of the cleaning member 66 in terms of the sliding direction M, and FIG. 10C is a plan view diagram of the cleaning member 66 in terms of a direction which is perpendicular to the sliding direction M. In FIGS. 10B and 10C, the cleaning member 66 comprises a high angle of contact member 661 which slides over the sliding start region 501 of the liquid ejection surface 50*a* of the head 50, and a low angle of contact member 662 which has a smaller angle of contact with respect to the ink than the high angle of contact member 661 and which slides over the region of the liquid ejection surface 50*a* of the head 50 apart from the sliding start region 501, including the sliding end region 503. More specifically, the front end section 66*b* of the cleaning member 66 has an area (high angle of contact member 661) which is subject to a surface treatment to have a high angle of contact and an area (low angle of contact member 662) which is subject to a surface treatment to have a low angle of contact. Moreover, the image forming apparatus 100 in FIG. 10A comprises a cleaning member pressing force modification unit 168 which changes the pressure (pressing force) with which the cleaning member 66 presses against the liquid ejection surface 50*a* of the head 50. The remaining constituent elements are the same as those of the image forming apparatus 10 shown in FIG. 4, and since they have already been explained, further description thereof is omitted here.

Figure 10D:
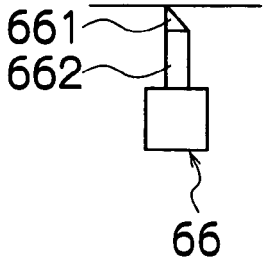

Before the start of cleaning, and more specifically, before the start of the first sliding process (wetting sliding process), the internal pressure of the sub tank 42 is set to a positive pressure by means of the pressure adjustment unit 162 (pressure meter 422, atmosphere connection port 423, atmosphere opening valve 424 and pressure adjustment pump 425). In other words, the back pressure of the head 50 is set to a positive pressure. In so doing, the ink surface (meniscus) of the liquid ejection ports of the head 50 is set to a projecting shape. In this state, the first sliding process (wetting sliding process) is started. The cleaning member 66 is slid over the sliding start region 501 of the liquid ejection surface 50*a* at a weak pressing force, which is set by the cleaning member pressing force modification unit 168. Consequently, as shown in FIG. 10D, the high angle of contact member 661 at the front end section of the cleaning member 66 slides over the liquid ejection surface 50*a*, and the liquid ejection surface 50*a* becomes wetted by the ink which has seeped out from the liquid ejection ports of the head 50.

Figure 10E:
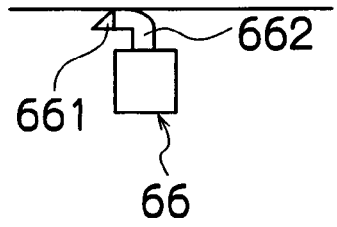

When the cleaning member 66 goes beyond the sliding start region 501 of the liquid ejection surface 50*a* (in other words, the cleaning member 66 pass over a portion other than the sliding start region 501, of the liquid ejection surface 50*a*), then the pressing force of the cleaning member 66 is increased by the cleaning member pressing force modification unit 168. In this case, as shown in FIG. 10E, the low angle of contact member 662 of the front end section of the cleaning member 66 slides over the liquid ejection surface 50*a*. Consequently, the amount of ink adhering to the liquid ejection surface 50*a* is reduced.

When the first sliding process (wetting sliding process) has been completed, the pressure inside the sub tank 42 is set to a negative pressure by the pressure adjustment unit 162. In other words, the back pressure of the head 50 is set to a negative pressure. Thereupon, a second sliding process (wiping sliding process) is carried out. In this case, the high angle of contact area 661 of the cleaning member 66 is pressed against the liquid ejection surface 50*a* at a week pressing force, which is set by the cleaning member pressing force modification unit 168. Here, as shown in FIG. 10D, the high angle of contact member 661 of the front end section of the cleaning member 66 slides over the liquid ejection surface 50*a*, thereby wiping away ink, and the like, on the liquid ejection surface 50*a*. In this case, the application of the ink surface vibration waveform to the head 50 is halted, and therefore ink does not seep out onto the liquid ejection surface 50*a*.

The reason that the amount of seeped ink increases, the greater the angle of contact, is thought to be because, in the state shown in FIGS. 6B and 6C, the amount of seeped ink is influenced by the size of the mounding of the ink surface formed between the liquid ejection surface 50*a* and the blade 66*a*, and the higher the angle of contact, the larger the mounded shape of the ink surface.

Fifthly, there is a mode which adjusts the amount of seeped ink by adjusting the wait time. Here, the wait time is the standby time from the end of the wetting sliding process (first sliding process) until the halting of the liquid surface slight vibration.

For example, if the wait time is changed within a range of 0 to 60 (sec), then the shorter the wait time (the nearer the wait time to the lower limit of 0 (sec)), the smaller the amount of seeped ink, and the longer the wait time (the nearer the wait time to the upper limit of 60 (sec)), the greater the amount of seeped ink.

The wait time is adjusted by the print controller 150 in FIG. 1, by means of the head drive unit 154 and the timer 153.

In particular, if the determination of ejection failures is also combined and if the number of ports suffering ejection failure is high, then it is effective to increase the length of the wait time. By increasing the length of the wait time, it is possible to expel ink of increased viscosity of the liquid ejection ports 51, and to dissolve the solidified ink attached to the liquid ejection surface. Moreover, if there is severe soiling of the liquid ejection surface, or if there is a large number of ejection direction errors, then it is effective to increase the length of the wait time.

Cleaning Process

Figure 11:
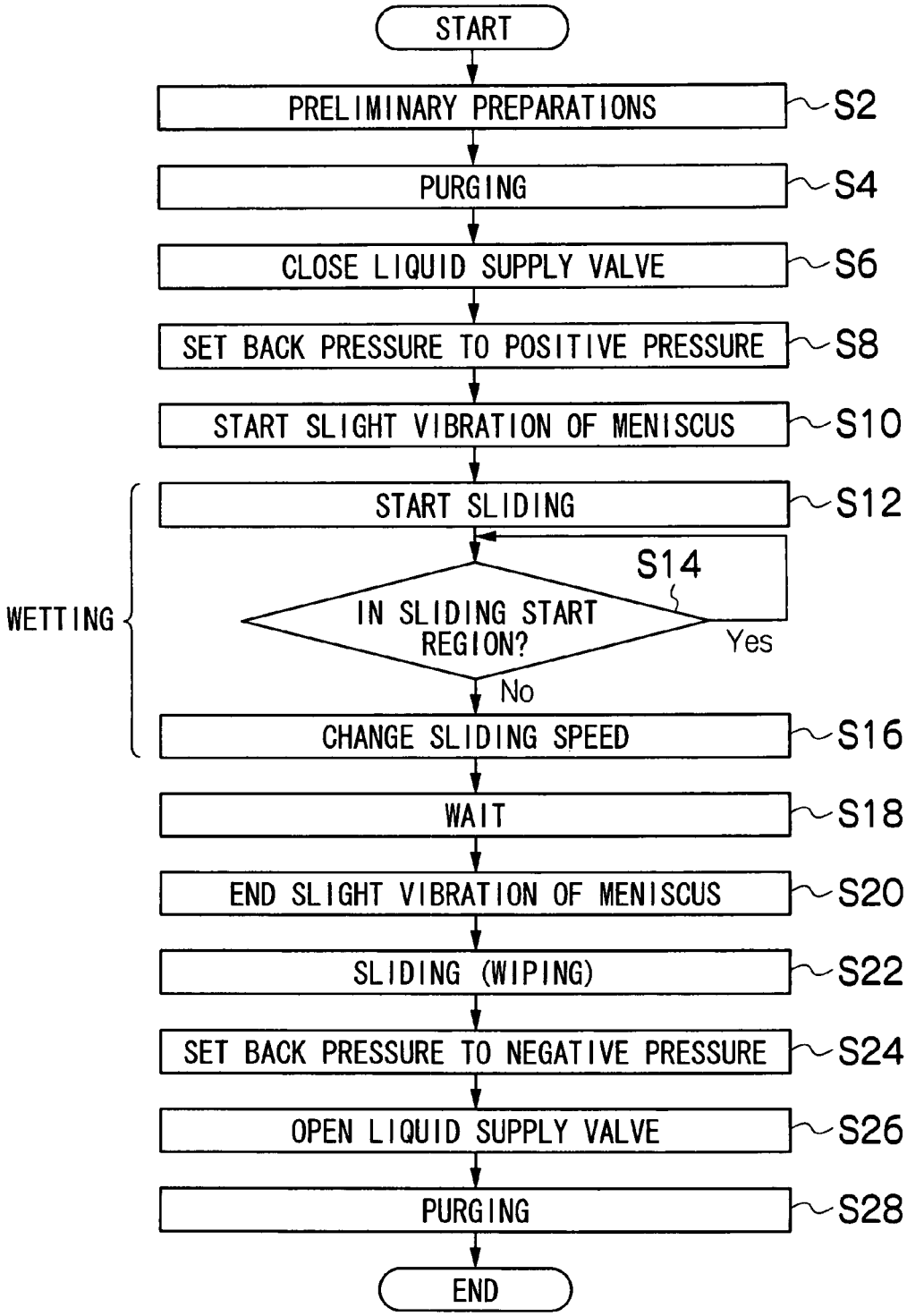
FIG. 11 is a flowchart showing the sequence of one example of a cleaning process for the liquid ejection surface in a mode which adjusts the amount of seeped ink by means of the sliding speed.

FIG. 11 is a flowchart showing the sequence of one example of a cleaning process for the liquid ejection surface in the first mode which adjusts the amount of seeped ink by changing the sliding speed.

In FIG. 11, prescribed preliminary preparations are carried out (S2). Here, the amount of remaining ink in the sub tank 42, which has been determined by the remaining ink amount sensor 421 in FIG. 4, is compared with a previously determined specified value, and if the remaining amount of ink is equal to or less than the specified value, then replenishment of ink is carried out. The replenishment of the ink is carried out by moving the head 50 to a maintenance position where it opposes the liquid receptacle 64 in FIG. 4, sealing the liquid ejection surface 50*a* of the head 50 by means of the liquid receptacle 64, opening the atmosphere opening valve 424 of the sub tank 42 and thereby connecting the interior of the sub tank 42 with the atmosphere, and then driving the liquid supply pump 61 in a state where the liquid supply valve 62 is opened. By this means, the ink is prevented from running out during the wetting sliding process (first sliding process) described below.

Next, preliminary ejection (purging) before cleaning is carried out (S4). The purging is performed after moving the head 50 to the maintenance position opposing the liquid receptacle 64 if the head 50 is not already located in the maintenance position. By applying drive signals for purging to the piezoelectric elements 58 of the head 50 shown in FIG. 3, from the head drive unit 154, the ink of the ink surface in the liquid ejection ports 51, which has increased in viscosity, is expelled to the outside of the head 50.

Next, the liquid supply valve 62 in FIG. 4 is closed (S6). Thereby, the connection between the ink tank 60 and the sub tank 42 is cut off.

Thereupon, the back pressure of the head 50 is set to a positive pressure (S8). Here, by measuring the pressure by means of the pressure meter 422 in FIG. 4, as well as driving the pressure adjustment pump 425 to apply pressure to the sub tank 42, the back pressure of the head 50 is set to a positive pressure within the target range. By setting the back pressure of the head 50 to a positive pressure in this way, the ink which has seeped out from the liquid ejection ports 51 is prevented from returning back into the interior of the liquid ejection ports 51 during the wetting sliding process, which is described below. Here, the pressure is set to 30 $mmH_2O$, for example.

Thereupon, slight vibration of the liquid surface is started (S10). Here, the meniscus slight vibration waveform is applied to each piezoelectric element 58 shown in FIG. 3 of the head 50, from the head drive unit 154, and the ink surface of the liquid ejection ports 51 of the head 50 is caused to perform a slight vibration. The meniscus slight vibration waveform must be set to a waveform which does not cause liquid to be ejected from any of the liquid ejection ports 51. This slight vibration of the liquid surface has the effect of accelerating the seeping out of the ink.

Figure 12A:
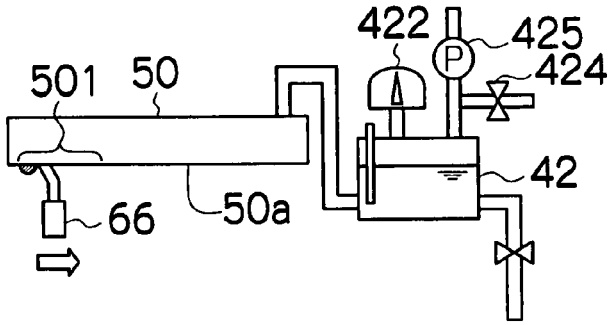
FIGS. 12A to 12E are illustrative diagrams for describing the liquid ejection surface cleaning process shown in FIG. 11.

Thereupon, as shown in FIG. 12A, the first sliding motion of the cleaning member 66 over the liquid ejection surface 50*a* is started (S12).

By setting the back pressure (S8) and applying a slight vibration to the liquid surface (S10), the cleaning member 66 contacts an ink surface which has a projecting shape and is performing a fine vibration, and this ink surface is ruptured and ink seeps out and spreads over the liquid ejection surface 50*a*. The amount of seeped ink becomes larger, the slower the sliding motion of the cleaning member 66, and the greater the angle of contact of the blade 66*a* of the cleaning member 66.

Figure 12B:
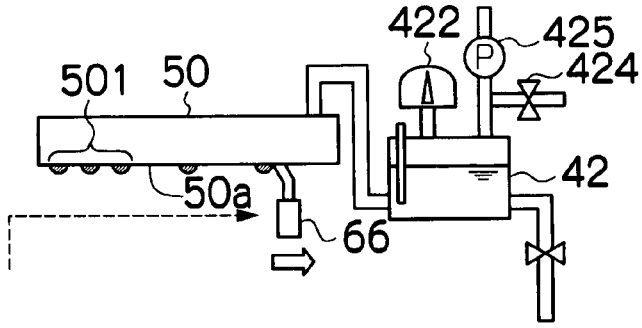

It is judged whether or not the cleaning member 66 is sliding over the sliding start region 501 of the liquid ejection surface 50*a* (S14), and if it is judged that the cleaning member 66 is sliding over a region outside the sliding start region 501, then the sliding speed of the cleaning member 66 which is caused to slide by the cleaning member movement unit 166 is changed, and the sliding of the cleaning member 66 is continued as shown in FIG. 12B (S16). In other words, by changing the sliding speed, the amount of seeped ink from the liquid ejection ports 51 in the region other than the sliding start region is reduced in comparison with the amount of seeped ink from the liquid ejection ports 51 in the sliding start region. For example, the sliding speed in the sliding start region is 20 mm/sec, and the sliding speed in the region apart from this is 80 mm/sec.

Figure 12C:
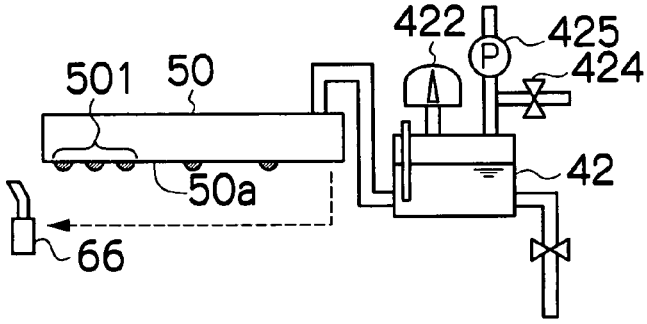

After waiting for a prescribed period of time (S18), the slight vibration of the liquid surface is terminated (S20). In other words, after waiting for the previously described wait time, by using the timer 153 in FIG. 1, the application of the meniscus slight vibration waveform to the piezoelectric elements 58 of the head 50 from the head drive unit 154 in FIG. 1 is halted. As shown in FIG. 12C, the cleaning member 66 is returned to the vicinity of the sliding start position.

It is possible to adjust the amount of seeped ink by changing the wait time. If the wait time is increased, then the amount of seeped ink increases.

By ending the slight vibration of the liquid surface, the seeping of the ink is restricted. Incidentally, after the slight vibration of the liquid surface is halted, the back pressure of the head 50 is maintained at a positive pressure, and therefore a slight amount of ink does seep out even.

Figure 12D:
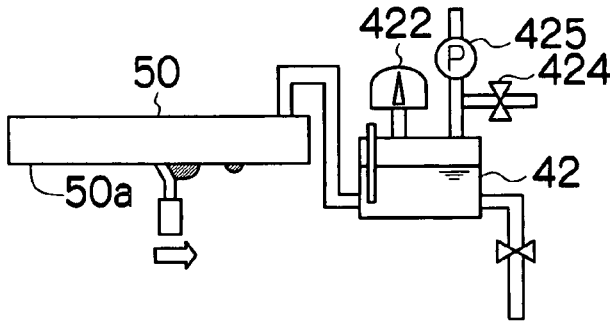

Thereupon, the cleaning member 66 performs a wiping action of sliding over the liquid ejection surface 50*a*, as shown in FIG. 12D (S22). By this means, it is possible to remove dirt and ink into which adhering matter attached to the liquid ejection surface 50*a* has dissolved, from the liquid ejection surface 50*a* of the head 50. Since the liquid ejection surface 50*a* of the head 50 is wetted sufficiently by the wetting process (S12 to S14), then no damage is caused to the liquid ejection surface 50*a* (for example, the lyophobic film thereon) by the cleaning member 66.

Figure 12E:
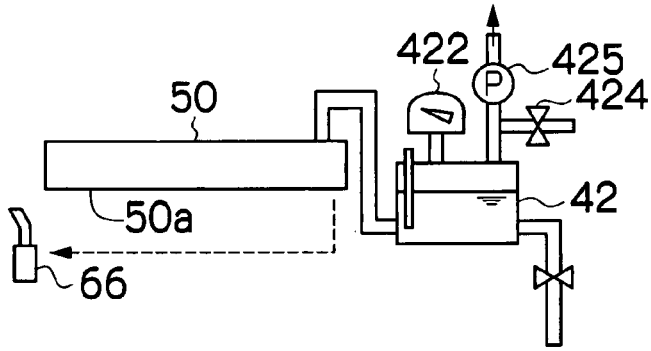

Next, as shown in FIG. 12E, the pressure adjustment pump 425 is driven in reverse, while the pressure meter 422 measures the internal pressure of the sub tank 42, thereby setting the back pressure of the head 50 to the same negative pressure as that set during ejection standby (S24). The prescribed back pressure can be set rapidly by opening the atmosphere opening valve 424 of the sub tank 42, to the atmosphere, and then driving the pressure adjustment pump 425.

Thereupon, the liquid supply valve 62 in FIG. 4 is opened (S26). Accordingly, the sub tank 42 is connected to the ink tank 60.

Next, dummy ejection (purging) after cleaning is carried out (S28). More specifically, ink is ejected toward the liquid receptacle 64 from the liquid ejection ports 51 of the head 50.

Figure 13:
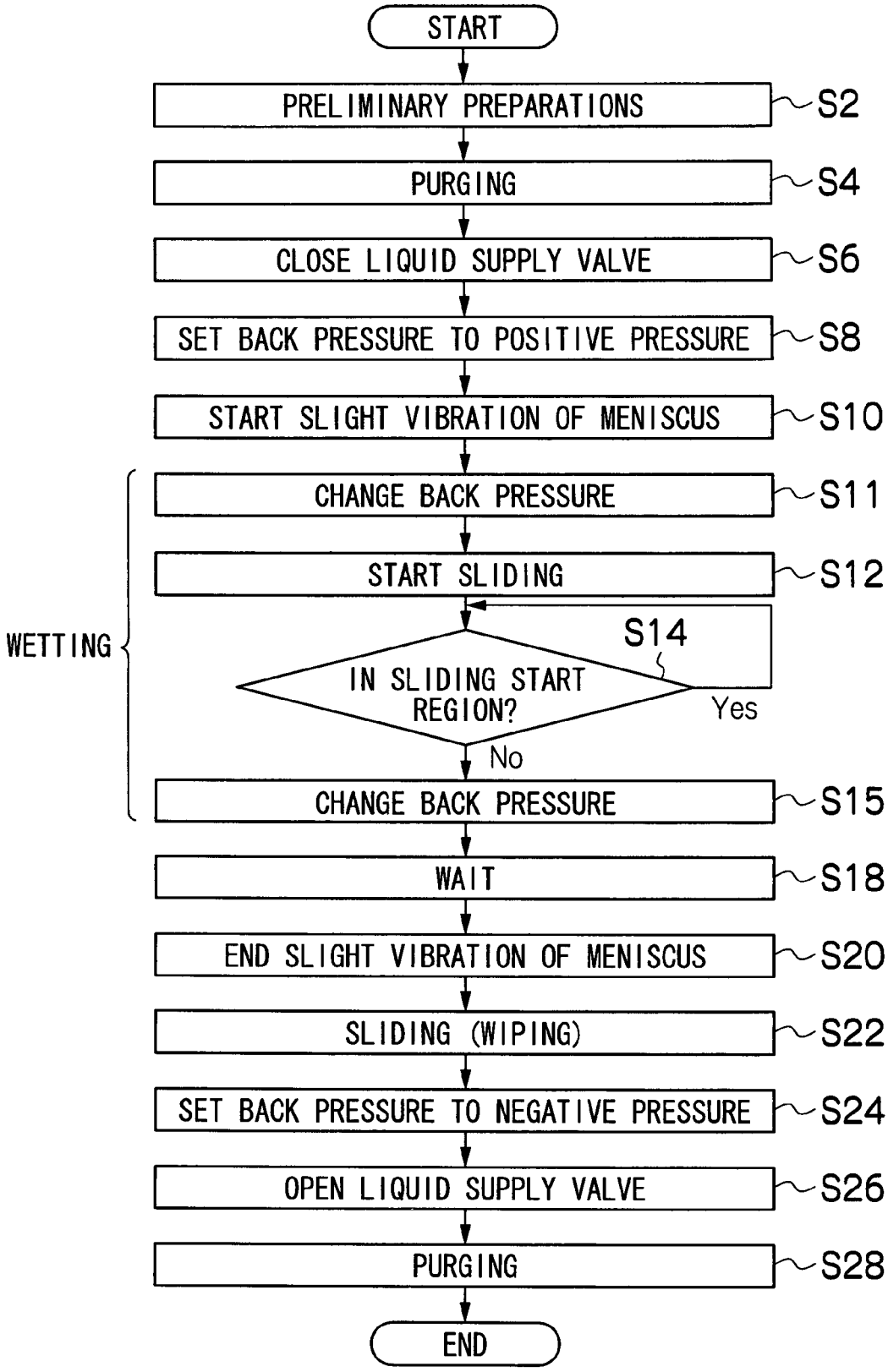
FIG. 13 is a flowchart showing the sequence of one example of a cleaning process for the liquid ejection surface in a mode which adjusts the amount of seeped ink by means of the back pressure of the head.

FIG. 13 is a flowchart showing the sequence of one example of a liquid ejection surface cleaning process in the second mode which adjusts the amount of seeped ink by changing the back pressure of the head 50.

In FIG. 13, the steps S2 to S10 are the same as the process of the first mode shown in FIG. 11, and they comprise: preliminary preparations (S2), purging (S4), closing the liquid supply valve 62 (S6), setting the back pressure of the head 50 to a positive pressure (S8), and starting slight vibration of the liquid surface (S10).

Figure 14A:
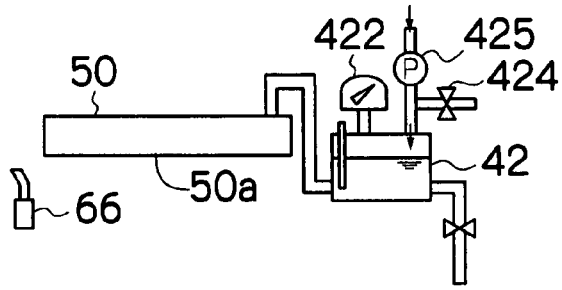
FIGS. 14A to 14F are illustrative diagrams for describing the liquid ejection surface cleaning process shown in FIG. 13.
Figure 14B:
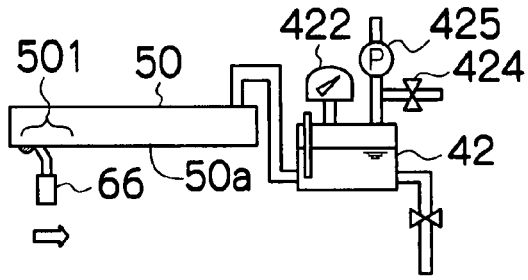
Figure 14C:
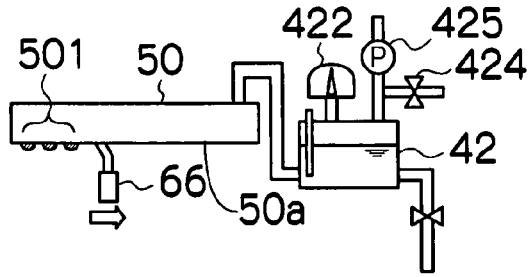

In the present mode, as shown in FIG. 14A, by driving the pressure adjustment pump 425 while measuring the internal pressure of the sub tank 42 (in other words, the back pressure of the head 50) by means of the pressure meter 422, the back pressure of the head 50 is changed to a pressure for the sliding start region (S11). Thereupon, as shown in FIG. 14B, when the first sliding motion of the cleaning member 66 over the liquid ejection surface 50*a* is started (S12), it is judged whether or not the cleaning member 66 is sliding over the sliding start region 501 of the liquid ejection surface 50*a* (S14), and if it is judged that the cleaning member 66 is sliding in a region outside the sliding start region 501, then the back pressure of the head 50 is changed by means of the pressure adjustment unit 162 and the sliding of the cleaning member 66 is continued as shown in FIG. 14C (S15).

At steps S11 and S15, the back pressure of the head 50 when the cleaning member 66 is slid over the sliding start region 501 of the liquid ejection surface 50*a* is set to being higher than the back pressure of the head 50 when the cleaning member 66 is slid over a region of the liquid ejection surface 50*a* other than the sliding start region 501.

Figure 14D:
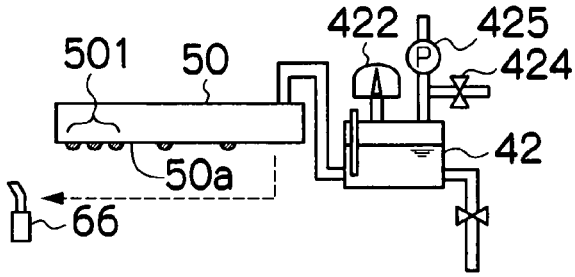
Figure 14E:
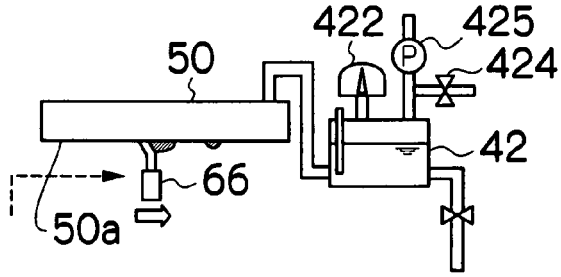
Figure 14F:
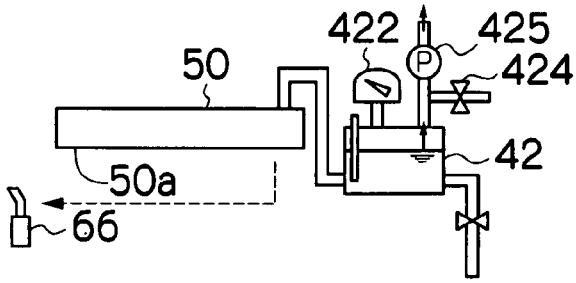

Steps S18 to S28 are the same as the process in the first mode shown in FIG. 11. After waiting for a prescribed period of time (S18), the slight vibration of the liquid surface is terminated (S20). As shown in FIG. 14D, the cleaning member 66 is returned to the vicinity of the sliding start position. Thereupon, as shown in FIG. 14E, wiping is performed by sliding the cleaning member 66 over the liquid ejection surface 50*a* (S22), and as shown in FIG. 14F, the back pressure of the head 50 is set to a negative pressure (S24), the liquid supply valve 62 is opened (S26), and purging is carried out (S28).

It is also possible to use a combination of the various modes for adjusting the amount of seeped ink described with reference to FIG. 7. For example, it is possible to adjust both the sliding speed and the back pressure of the head 50, or to combine all of the adjustment modes.

Moreover, an example has been described in which the same cleaning member 66 is slid in the wetting sliding process (the first sliding process) and the wiping sliding process (the second sliding process), but it is also possible to slide different cleaning members in the wetting sliding process and the wiping sliding process.

Furthermore, the mode of changing the sliding speed of the cleaning member 66, in other words, the mode of providing regions 501 of slower sliding speed at uniform intervals, is described above with reference to FIG. 9, but the mode of changing the amount of seeped liquid from the liquid ejection ports 51 of the head 50 at particular positions on the liquid ejection surface 50*a* of the head 50 is not limited in particular to a mode where the sliding speed (the relative speed between the cleaning member 66 and the head 50) is changed. More specifically, as described previously with respect to FIG. 7, there are also a mode in which the pressure (back pressure) inside the head 50 is switched, a mode in which the number of preliminary ejections is switched, a mode in which the angle of contact is switched, and the like.

Moreover, as described previously, in switching the amount of seeped liquid at a particular position on the liquid ejection surface 50*a* of the head 50, in addition to a mode in which the print controller 150 in FIG. 1 implements the switching by converting the elapsed time from the sliding start time, to the position, by using the timer 153, there is also a mode, for instance, in which a device for detecting the position of the cleaning member 66 (not illustrated) is provided and switching is performed on the basis of the position determined by this device.

Furthermore, a mode is described in which the amount of seeped liquid is switched at a particular position on the liquid ejection surface 50*a* of the head 50, but it is also possible to use the same seepage conditions over the whole region of the liquid ejection surface 50*a* (the surface in which the nozzles 51 are arranged). In other words, the seepage conditions, such as the sliding speed of the cleaning member 66, the number of preliminary ejections, the angle of contact, and the like, are set to the same conditions over the whole region of the liquid ejection surface 50*a*.

When the same seepage conditions are used for the whole region of the liquid ejection surface 50*a* in this way, then improvement in the cleaning characteristics of the liquid ejection surface 50*a* can be achieved if the amount of seeped liquid is switched for the whole region of the liquid ejection surface 50*a*, in accordance with the state in relation to liquid ejection by the head 50 of the image forming apparatus 10. For example, the amount of seeped liquid is switched in the prescribed states, for instance, if the frequency of passage of the ejection receiving medium 16 (the frequency at which the recording medium 16 is passed over the liquid ejection surface 50*a*) exceeds a prescribed value, or if the head 50 is left in a non-ejection state for a time exceeding a prescribed time, or if an ejection abnormality of the head 50 is determined (including judgment by the user on the basis of a nozzle check pattern), or if jamming of the ejection receiving medium 16 has been restored, or if the power of the image forming apparatus 10 is switched on, or the like. More specifically, the print controller 150 judges whether or not the amount of seeped liquid from the liquid ejection ports 51 of the head 50 has increased compared to a normal state, and the switching is carried out so that the amount of seeped liquid in the first sliding motion (wetting sliding) is increased, compared to a normal state, immediately after the frequency of passage of the ejection receiving medium 16 exceeds a prescribed value, or after the head 50 is left in a non-ejection state for a time exceeding a prescribed time, or after an ejection abnormality of the head 50 is determined, or after jamming of the ejection receiving medium 16 has been restored, or after the power of the image forming apparatus 10 is switched on.

Embodiments of the present invention are described above with respect to a case where the liquid ejected from the head 50 is ink, but the present invention may also be applied to cases where any treatment liquid other than ink, or another industrial liquid, is ejected.

Moreover, a case is described in which piezoelectric elements are used as pressure generating devices, but the present invention can also be applied, for example, to a case where other pressure generating devices, such as heaters, are used.

The present invention is not limited to the examples described in the present specification and shown in the drawings, and various design modifications and improvements may of course be implemented without departing from the scope of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a liquid ejection head including: a liquid ejection surface in which a plurality of liquid ejection ports which eject liquid are arranged; a plurality of pressure chambers which contain the liquid and are connected to the liquid ejection ports, respectively; and a plurality of pressure generating devices which apply pressure to the liquid contained in the pressure chambers, respectively;

a sub tank, arranged external to the liquid ejection head, which contains the liquid and supplies the liquid to the liquid ejection head;

a main tank which contains the liquid and supplies the liquid to the sub tank;

a pressure adjustment device which includes a pressure adjustment pump which replenishes or expells gas to adjust pressure inside the sub tank, the pressure adjustment device adjusting back pressure in the liquid ejection head by adjusting the pressure inside the sub tank with the pressure adjustment pump;

a head drive device which applies selectively, to the pressure generating devices, a liquid ejection drive waveform which causes the liquid to be ejected from the liquid ejection ports of the liquid ejection head, and a meniscus slight vibration waveform which causes a surface of the liquid of each of the liquid ejection ports to perform slight vibration to an extent whereby the liquid is not ejected from the liquid ejection ports of the liquid ejection head;

a cleaning member which slides over the liquid ejection surface of the liquid ejection head; and a control device which controls a first sliding motion in which the cleaning member slides over the liquid ejection surface of the liquid ejection head, and a second sliding motion in which the cleaning member slides over the liquid ejection surface of the liquid ejection head following the first sliding motion to wipe the liquid ejection surface, wherein:

the first sliding motion is performed in a state where interior of the liquid ejection head is pressurized by the pressure adjustment device to set the surface of the liquid of each of the liquid ejection ports of the liquid ejection head to a projecting shape, and where the meniscus slight vibration waveform is applied to the pressure generating devices by the head drive device, in such a manner that the liquid ejection surface is wetted by the liquid which seeps out from the liquid ejection ports; and the second sliding motion is performed in a state where the application of the meniscus slight vibration waveform to the pressure generating devices is halted.

2. The liquid ejection apparatus as defined in claim 1, wherein, in the first sliding motion, the control device sets the back pressure in the liquid ejection head when the cleaning member slides over a particular region of the liquid ejection surface of the liquid ejection head, to a higher pressure than the back pressure in the liquid ejection head when the cleaning member slides over other regions of the liquid ejection surface of the liquid ejection head, by using the pressure adjustment device.

3. The liquid ejection apparatus as defined in claim 1, wherein, in the first sliding motion, the control device sets speed of the cleaning member with respect to the liquid ejection head when the cleaning member slides over a particular region of the liquid ejection surface of the liquid ejection head, to a slower speed than the speed of the cleaning member with respect to the liquid ejection head when the cleaning member slides over other regions of the liquid ejection surface of the liquid ejection head.

4. The liquid ejection apparatus as defined in claim 1, wherein the control device controls preliminary ejections in which the liquid is caused to be ejected preliminarily from the liquid ejection ports of the liquid ejection head by means of the head drive device prior to the first sliding motion in such a manner that number of the preliminary ejections from the liquid ejection ports in a particular region of the liquid ejection surface of the liquid ejection head is set to a greater number than the number of the preliminary ejections from the liquid ejection ports in other regions of the liquid ejection surface of the liquid ejection head.

5. The liquid ejection apparatus as defined in claim 1, wherein an angle of contact between the cleaning member and the liquid ejection surface in regions, other than a particular region, of the liquid ejection surface of the liquid ejection head is smaller than an angle of contact between the cleaning member and the liquid ejection surface in the particular region of the liquid ejection surface of the liquid ejection head.

6. The liquid ejection apparatus as defined in claim 2, wherein the particular region of the liquid ejection surface is a sliding start region where the cleaning member starts sliding over the liquid ejection surface of the liquid ejection head.

7. The liquid ejection apparatus as defined in claim 3, wherein the particular region of the liquid ejection surface is a sliding start region where the cleaning member starts sliding over the liquid ejection surface of the liquid ejection head.

8. The liquid ejection apparatus as defined in claim 4, wherein the particular region of the liquid ejection surface is a sliding start region where the cleaning member starts sliding over the liquid ejection surface of the liquid ejection head.

9. The liquid ejection apparatus as defined in claim 5, wherein the particular region of the liquid ejection surface is a sliding start region where the cleaning member starts sliding over the liquid ejection surface of the liquid ejection head.

10. A liquid ejection surface cleaning method of cleaning a liquid ejection surface of a liquid ejection head by using a cleaning member which slides over the liquid ejection surface, a sub tank and pressure adjustment pump that are external to the liquid ejection head and adjust back pressure of the liquid ejection head, the liquid ejection head including: the liquid ejection surface in which a plurality of liquid ejection ports which eject liquid are arranged; a plurality of pressure chambers which contain the liquid and are connected to the liquid ejection ports, respectively; and a plurality of pressure generating devices which apply pressure to the liquid contained in the pressure chambers, respectively, the sub tank which supplies the liquid to the liquid ejection head, a main tank which supplies the liquid to the sub tank, and the pressure adjustment pump which replenishes or expels gas to adjust pressure inside the sub tank, the liquid ejection surface cleaning method comprising the steps of:

sliding the cleaning member over the liquid ejection surface of the liquid ejection head, in a state where interior of the liquid ejection head is pressurized by using the pressure adjustment device which adjusts back pressure in the liquid ejection head by adjusting the pressure inside the sub tank with the pressure adjustment pump to set a surface of the liquid of each of the liquid ejection ports of the liquid ejection head to a projecting shape, and where a meniscus slight vibration waveform of an extent whereby the liquid is not ejected from the liquid ejection ports of the liquid ejection head is applied to the pressure generating devices by using a head drive device which drives the pressure generating devices to wet the liquid ejection surface with the liquid that seeps out from the liquid ejection ports; and sliding the cleaning member over the liquid ejection surface of the liquid ejection head in a state where the application of the meniscus slight vibration waveform to the pressure generating devices is halted to wipe the liquid ejection surface.

* * * * *